US009939755B2

(12) United States Patent
Kamikura et al.

(10) Patent No.: US 9,939,755 B2
(45) Date of Patent: Apr. 10, 2018

(54) IMAGE FORMING APPARATUS

(71) Applicant: CANON KABUSHIKI KAISHA, Tokyo (JP)

(72) Inventors: Takahiro Kamikura, Tokyo (JP); Satoru Takezawa, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/489,455

(22) Filed: Apr. 17, 2017

(65) Prior Publication Data

US 2017/0315466 A1 Nov. 2, 2017

(30) Foreign Application Priority Data

Apr. 28, 2016 (JP) ..... 2016-090308

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
USPC ..... 399/4, 37, 45, 51, 52, 220, 221
See application file for complete search history.

(56) References Cited

U.S. PATENT DOCUMENTS 8,665,303 B2 3/2014 Takezawa ..... 347/236
8,693,009 B2 * 4/2014 Furuya ..... B65H 5/068 271/110
9,367,005 B2 * 6/2016 Murrell ..... H04N 1/00724
2014/0093263 A1 * 4/2014 Anderson ..... G03G 15/043 399/51
2017/0052473 A1 2/2017 Seki et al. ..... G03G 15/043

FOREIGN PATENT DOCUMENTS

JP 2011- 025502 A 2/2011

OTHER PUBLICATIONS

U.S. Appl. No. 15/450,798, filed Mar. 6, 2017.

* cited by examiner

*Primary Examiner* — Hoan Tran
(74) *Attorney, Agent, or Firm* — Fitzpatrick, Cella, Harper & Scinto

(57) ABSTRACT

An image forming apparatus including: a setting unit configured to set light intensity correction data stored in a storage unit according to an exposure position while a light beam is being scanned on a photosensitive member at a first scan speed; and a light intensity controller configured to control a light intensity based on the correction data set by the setting unit, wherein the setting unit calculates a light intensity correction data corresponding to a position between a plurality of positions based on the stored correction data, set the correction data according to the exposure position while the light beam is being scanned at a second scan speed lower than the first scan speed; and fixes a switching period for switching the correction data according to the exposure position while the light beam is being scanned on an image forming area of the photosensitive member regardless of the scan speed.

8 Claims, 22 Drawing Sheets

IMAGE FORMING APPARATUS

BACKGROUND OF THE INVENTION

Field of the Invention

The present invention relates to an image forming apparatus configured to control a light intensity of a light beam for scanning the light beam on a photosensitive member.

Description of the Related Art

In recent years, an electrophotographic image forming apparatus, for example, a copying machine or a laser beam printer, is demanded to form an image with high image quality and high precision. In general, such an image forming apparatus is provided with a light scanning device including a deflector, for example, a rotary polygon mirror or a galvanometer mirror, which is configured to deflect a light beam emitted from a light source so as to scan the light beam on a photosensitive member. The light scanning device includes a motor configured to rotate the rotary polygon mirror or a motor configured to reciprocate the galvanometer mirror and optical parts including an fθ lens and a reflecting mirror. The optical parts included in the light scanning device are configured to guide the light beam deflected by the deflector onto the photosensitive member. Optical characteristics including a transmittance of a lens and a reflectance of the reflecting mirror are not always uniform in a main scanning direction being a direction for scanning the light beam on the photosensitive member, and hence light intensities of the light beam at respective exposure positions on the photosensitive member become non-uniform. This raises a problem in that density unevenness occurs in an image when the light intensity of the light beam emitted from the light source is fixed.

In view of this, hitherto, correction (hereinafter referred to as "shading correction") for suppressing an occurrence of the density unevenness of an image that is ascribable to the optical characteristics of an optical member of the light scanning device is performed by controlling the light intensity of the light beam according to the exposure position of the photosensitive member in order to suppress the occurrence of the density unevenness. In Japanese Patent Application Laid-Open No. 2011-25502, there is disclosed a circuit configured to control a current flowing into the light source according to the exposure position of the light beam in order to execute the shading correction.

A recent image forming apparatus is configured to control an image forming speed depending on a sheet type. The image forming speed needs to be diversified in order to satisfactorily form images on various sheet types to be used by a user. Thus, a difference between the maximum value and the minimum value of the image forming speeds to be used in the same image forming apparatus has increased. It is possible to apply heat corresponding to the sheet type to toner by changing an image formation process speed and a sheet conveyance speed depending on the sheet type. In order to handle various image forming speeds, the image forming apparatus needs to scan the light beam at a scan speed corresponding to each of a plurality of image forming speeds. Therefore, the image forming apparatus needs to control a rotation speed of the rotary polygon mirror or a speed for reciprocating the galvanometer mirror depending on the image forming speed.

FIG. 20A is a diagram for illustrating a correction timing based on shading data during one scan period of the light beam and a light intensity distribution (shading correction distribution) of the light beam emitted from the light source based on the shading data. As illustrated in FIG. 20A, when the light beam is scanned in the main scanning direction at a predetermined scan speed, shading correction for setting the shading data at a period Td is executed. However, in a case where the scan speed of the light beam has been switched from the predetermined scan speed to another scan speed, a correction period and the exposure position of the light beam do not match each other when the shading correction based on the shading data is executed with use of the same period Td. This raises a problem in that the shading correction is not adequately executed. FIG. 20B is a diagram for illustrating the correction timing and the correction distribution based on the shading data during one scan period of the light beam, which are exhibited when the light beam is scanned at another scan speed lower than the predetermined scan speed. It is understood from FIG. 20B that the shading correction is not executed during the second half of one scan period because the shading correction is ended at some midpoint of one scan of the light beam in the main scanning direction.

In this manner, when a shading condition for a first scan speed is applied to shading correction for a second scan speed in an image forming apparatus capable of operating at a plurality of scan speeds, precision of the shading correction for the second scan speed deteriorates, and density unevenness occurs in an output image. By changing the shading condition depending on the scan speed, it is possible to suppress the deterioration in the precision of the shading correction for each scan speed. However, when the shading data is changed depending on the scan speed, the capacity of a memory needs to be increased in order to store the shading data for each scan speed, which leads to an increased cost of the image forming apparatus.

SUMMARY OF THE INVENTION

In view of this, the present invention provides an image forming apparatus which corrects a light intensity of a light beam in a scanning direction at a second scan speed with use of light intensity correction data corresponding to a first scan speed.

In order to solve the above-mentioned problems, according to one embodiment of the present invention, there is provided an image forming apparatus, which is configured to form an image on a recording medium, the image forming apparatus comprising:

an image forming portion comprising:

a photosensitive member to be rotated;

a light source configured to emit a light beam;

a deflection unit configured to deflect the light beam emitted from the light source so that the light beam is scanned on the photosensitive member;

a developing unit configured to develop an electrostatic latent image, which is formed on the photosensitive member through scanning of the light beam, with use of toner; and a transfer unit configured to transfer a toner image developed on the photosensitive member onto the recording medium, the image forming portion being configured to control an image forming speed depending on a type of the recording medium on which the image is to be formed, the image forming speed including: a conveyance speed of the recording medium; a rotation speed of the photosensitive member; and a scan speed of the light beam;

a fixing unit configured to fix the toner image, which has been transferred onto the recording medium, to the recording medium;

a storage unit configured to store a light intensity correction data used for correcting a light intensity of the light beam to a light intensity corresponding to each of a plurality of different positions in a scanning direction of the light beam in association with a first scan speed of the light beam;

a setting unit configured to:

set a light intensity correction data corresponding to an exposure position from among a plurality of light intensity correction data stored in the storage unit according to exposure positions of the light beam in the scanning direction while the light beam is being scanned on an image forming area of the photosensitive member at the first scan speed;

calculate a light intensity correction data corresponding to a position between the plurality of different positions in the scanning direction based on the plurality of light intensity correction data stored in the storage unit; and set the light intensity correction data stored in the storage unit and a calculated light intensity correction data according to the exposure position of the light beam in the scanning direction while the light beam is being scanned on the image forming area of the photosensitive member at a second scan speed lower than the first scan speed; and a light intensity controller configured to control the light intensity of the light beam based on the light intensity correction data set by the setting unit, wherein the setting unit fixes a switching period of the light intensity correction data while the light beam is being scanned on the image forming area of the photosensitive member regardless of the scan speed, and switches the light intensity correction data according to the exposure position of the light beam at the switching period to set the light intensity correction data.

Further features of the present invention will become apparent from the following description of exemplary embodiments with reference to the attached drawings.

DESCRIPTION OF THE EMBODIMENTS

Now, with reference to the attached drawings, embodiments of the present invention will be described. An image forming apparatus 120 according to the embodiments is configured to form an image on a recording medium by an electrophotographic printing method while performing shading correction by smoothing a pulse width modulation signal (hereinafter referred to as "PWM signal") being a drive signal.

First Embodiment (Image Forming Apparatus)

Figure 1:
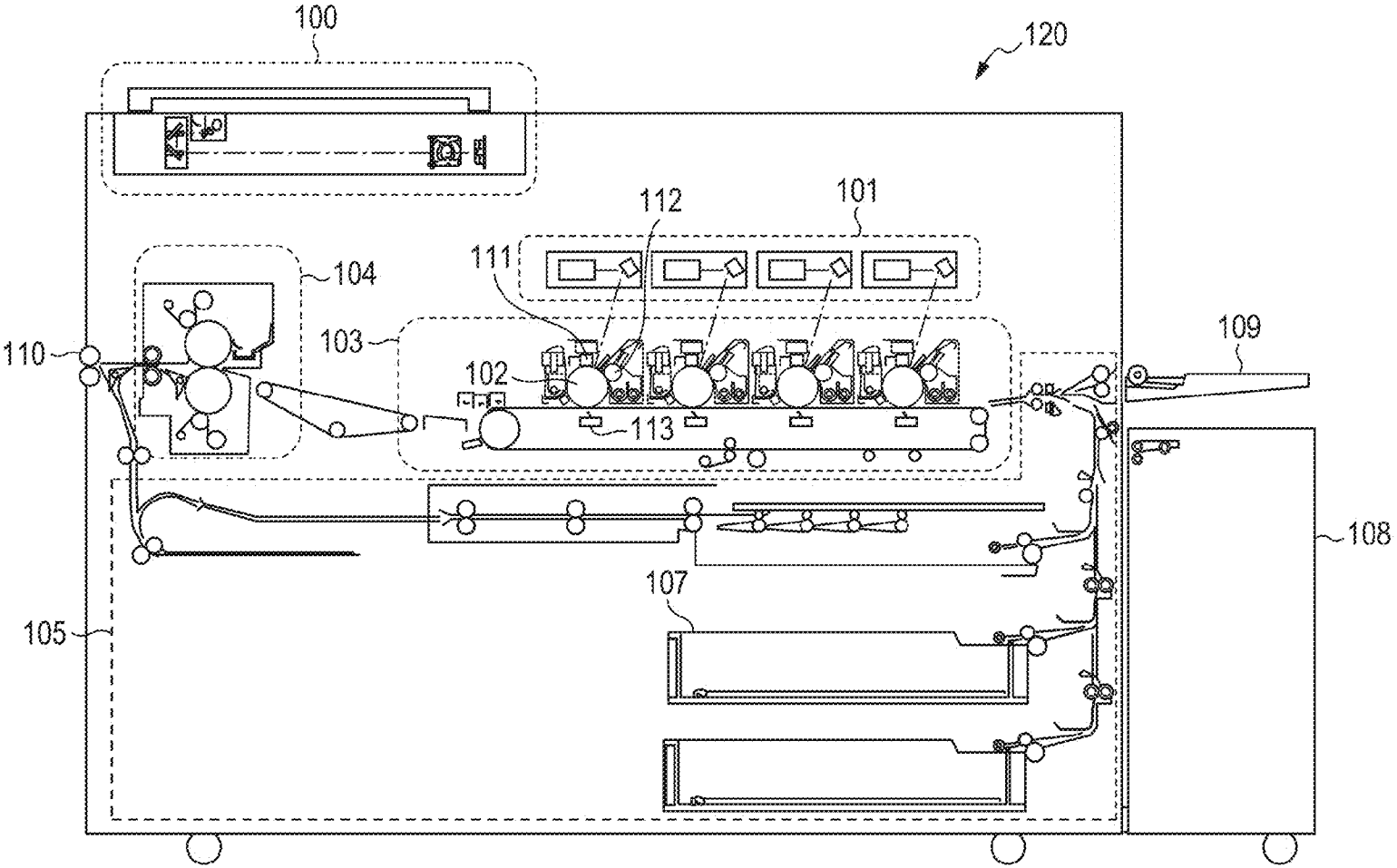
FIG. 1 is a view for illustrating an image forming apparatus according to a first embodiment.

An electrophotographic image forming apparatus 120 according to a first embodiment will be described. FIG. 1 is a view for illustrating the image forming apparatus 120 according to the first embodiment. The image forming apparatus 120 includes an image reading portion 100, a light scanning device 101, a photosensitive drum 102, an image forming portion 103, a fixing portion 104, a conveying portion 105, and a printer control portion (not shown) configured to control those portions. The image reading portion 100 is configured to irradiate an original placed on an original platen with illumination light to convert light reflected from the original into an electrical signal, to thereby generate image data. The light scanning device 101 is configured to cause a light ray (hereinafter referred to as "light beam"), for example, laser light, which is modified based on the image data, to enter a rotary polygon mirror (deflector) that rotates at a constant angular velocity, to thereby emit the light beam deflected by the rotary polygon mirror toward the photosensitive drum 102.

The image forming portion 103 serving as an image forming unit includes the photosensitive drum 102, a charging device 111, a developing device 112, a transfer member 113, and a cleaning member. The photosensitive drum 102 serving as a photosensitive member is rotated (driven to rotate) about a rotary axis. The charging device 111 is configured to uniformly charge a surface (surface to be scanned) of the photosensitive drum 102. The light scanning device 101 is configured to scan a light beam on the uniformly-charged surface of the photosensitive drum 102 in a scanning direction (hereinafter referred to as "main scanning direction") to form an electrostatic latent image. The scanning direction is a direction parallel to the rotary axis of the photosensitive drum 102. The developing device 112 serving as a developing unit is configured to develop the electrostatic latent image with toner to form a toner image. Meanwhile, the conveying portion 105 is configured to separate one by one recording media (hereinafter referred to as "sheets") that are stacked on a sheet feed cassette 107, a sheet deck 108, or a manual feed tray 109 in accordance with an instruction from the printer control portion, to thereby convey the sheets to the image forming portion 103. The transfer member 113 serving as a transfer unit is configured to transfer the toner image onto the sheet. The cleaning member is configured to collect toner remaining on the photosensitive drum 102 after the transfer. In the embodiment, the image forming portion 103 uses toner of four colors of cyan (C), magenta (M), yellow (Y), and black (K). In order to form toner images of the respective colors, the image forming portion 103 includes four image forming stations arranged in one row.

The image forming portion 103 is configured to sequentially execute an operation for forming a magenta toner image, a yellow toner image, and a black toner image each time a predetermined time period elapses from the start of formation of a cyan toner image. The toner images of the respective colors are sequentially transferred onto the sheet to be superimposed on the sheet. The sheet having the toner images transferred thereon is conveyed to the fixing portion 104. The fixing portion 104 includes a combination of a roller and a belt, and has a heat source, for example, a halogen heater, built therein. The fixing portion 104 is configured to heat and pressurize the sheet, which passes through a nip portion formed by a pair of rollers, to melt the toner images, to thereby fix the toner images onto the sheet. With this, a full-color image is formed on the sheet. The sheet having the image formed thereon is delivered outside of the image forming apparatus 120 by a delivery portion 110. Further, when images are formed on both surfaces of the sheet, the conveying portion 105 conveys the sheet that has passed through the fixing portion 104 to a reverse conveyance path to convey the sheet to the image forming portion 103 again.

The image forming apparatus 120 can operate at a plurality of image forming speeds. The image forming apparatus 120 can switch the image forming speed among the plurality of image forming speeds depending on a sheet type (including paper quality, thickness, basis weight, and surface properties) and image quality. For example, at a fixing nip portion, thick paper has a larger amount of heat absorption than plain paper having a thickness and a basis weight that are smaller than those of the thick paper. When a recording medium has a large amount of heat absorption, thermal energy for melting toner decreases, which leads to poor fixing of a toner image. In view of this, when the sheet type is thick paper, the image forming apparatus according to the embodiment switches the image forming speed to a speed lower than the image forming speed for plain paper or thin paper, to thereby increase a time period required by the thick paper to pass through the fixing nip portion to a period longer than a time period required by the plain paper. By thus switching the image forming speed, it is possible to reduce the poor fixing of the toner image onto the recording medium. The image forming speed to be switched is not limited to a conveyance speed of the recording medium to be caused to pass through the fixing nip portion. The image forming apparatus according to the embodiment is configured to switch a rotation speed of the photosensitive drum in association with the conveyance speed of the recording medium at the fixing nip portion. The image forming apparatus according to the embodiment is further configured to switch a scan speed of a light beam depending on the rotation speed of the photosensitive drum. The image forming speed is switched depending on image forming speed information on each page, which is included in an image formation job output from an image processing portion provided to a main body of the image forming apparatus 120.

(Light Scanning Device)

Figure 2A:
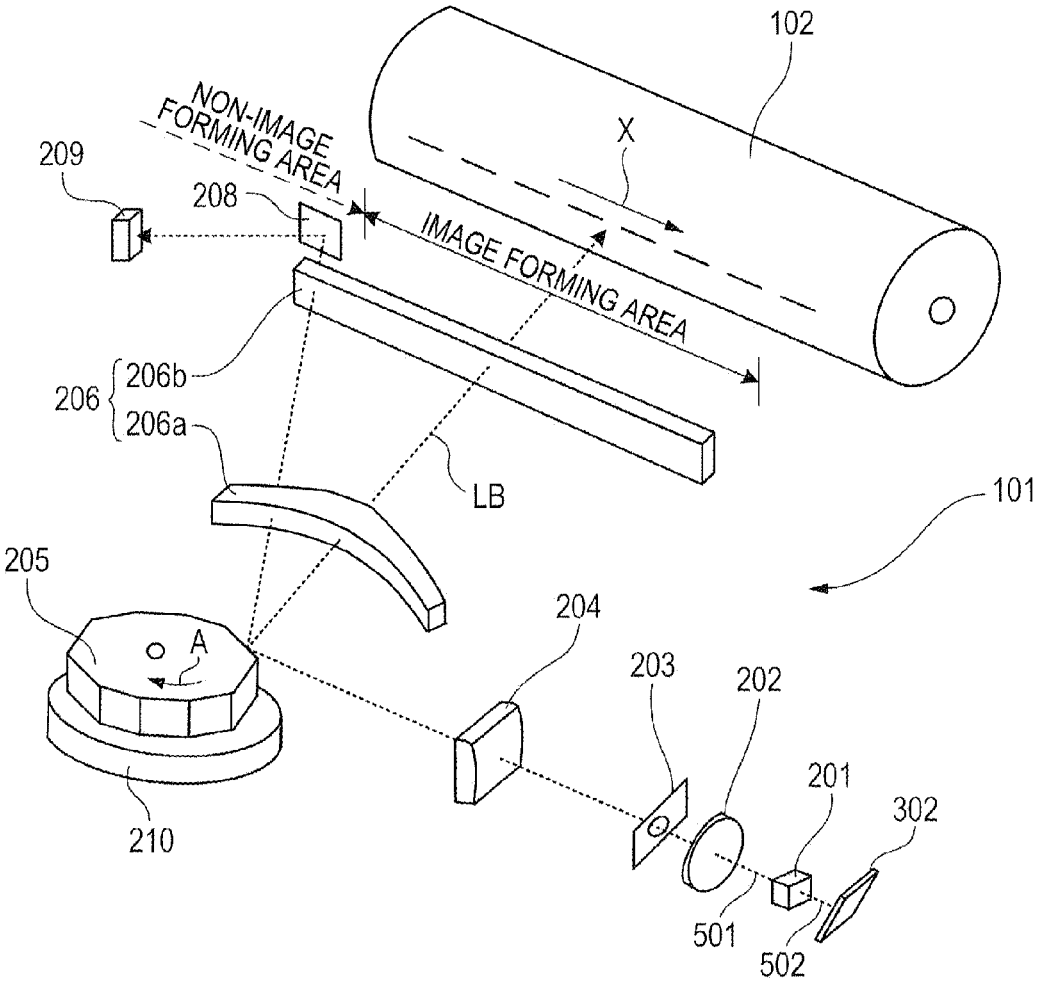
FIG. 2A and FIG. 2B are views for illustrating a light scanning device according to the first embodiment.
Figure 2B:
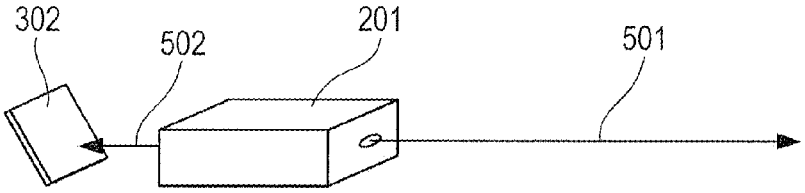

Now, the light scanning device 101 will be described. In the embodiment, the light scanning device 101 is provided for each of the four image forming stations. However, the light scanning device 101 may be one light scanning device common to the four image forming stations. FIG. 2A and FIG. 2B are views for illustrating the light scanning device 101 according to the first embodiment. FIG. 2A is the view for illustrating optical elements of the light scanning device 101 and the photosensitive drum 102. FIG. 2B is the view for illustrating a semiconductor laser (hereinafter referred to as "light source") 201 configured to emit a light beam and a photodiode (hereinafter referred to as "PD") 302 serving as a light receiving portion.

The light scanning device 101 includes an incident optical system including the light source 201, a collimator lens 202, a diaphragm 203, and a cylindrical lens 204. The light scanning device 101 further includes a rotary polygon mirror 205, which serves as a deflection unit configured to deflect a light beam so as to scan a light beam LB on the surface of the photosensitive drum 102 in the main scanning direction indicated by an arrow X, and a motor 210 configured to rotate the rotary polygon mirror 205 in a direction indicated by an arrow A. The light scanning device 101 further includes fθ lenses 206 (206*a* and 206*b*) serving as an imaging optical system configured to image the light beam on the surface of the photosensitive drum 102. The light scanning device 101 further includes a beam detector (hereinafter referred to as "BD") 209 and a BD reflecting mirror 208. The BD reflecting mirror 208 is arranged in a non-image forming area, which is located on an outer side of an image forming area of the photosensitive drum 102 in which the electrostatic latent image is formed, in the vicinity of the image forming area. The BD reflecting mirror 208 is configured to reflect the light beam deflected by the rotary polygon mirror 205 toward the BD 209. The BD 209 serving as a light receiving element is configured to receive the light beam to output a synchronization signal (hereinafter referred to as "BD signal") for determining the timing to start emission of the light beam in order to fix a writing start position of the electrostatic latent image in the main scanning direction. The synchronization signal is a signal generated one time per scan period during which the light beam is scanned on the photosensitive member. Therefore, the synchronization signal is a periodic signal indicating a scan period of the light beam. The BD 209 is a periodic signal generator configured to generate the periodic signal indicating the scan period of the light beam.

As illustrated in FIG. 2B, the light source 201 of the embodiment is an edge emitting laser configured to emit light beams from a semi-transparent mirror formed on both end surfaces of a semiconductor laser chip in two directions indicated by arrows 501 and 502. The light beam emitted toward the direction indicated by the arrow 501 is referred to as "front beam", and the light beam emitted toward the direction indicated by the arrow 502 is referred to as "rear beam". The front beam is guided to a surface of the photosensitive drum 102 to form an electrostatic latent image on the surface of the photosensitive drum 102. The rear beam is emitted with a light intensity having a fixed ratio of the front beam to enter the PD 302. In automatic light intensity control (automatic power control; hereinafter referred to as "APC") of the light source 201, the light intensity of the light beam emitted from the light source 201 is adjusted based on a detection signal (detection result) from the PD 302 serving as a detector configured to detect a light intensity. The light source 201 of the embodiment is not limited to the edge emitting laser, and may be a surface emitting laser, for example, a vertical cavity surface emitting laser (VCSEL) or a vertical external cavity surface emitting laser (VECSEL). Further, the light source 201 may be a single beam generator configured to emit a single light beam, and may be a multi-beam generator configured to emit a plurality of light beams.

With reference to FIG. 2A, the light beam (front beam) 501 emitted from the light source 201 is converted into substantially collimated light by the collimator lens 202, and is caused to have a predetermined shape by the diaphragm 203. The light beam is further converted into an elliptical image elongated in the main scanning direction by the cylindrical lens 204, and is emitted onto a refection surface of the rotary polygon mirror 205 with a predetermined beam diameter. The rotary polygon mirror 205 is rotated in the direction indicated by the arrow A by the motor 210. The light beam deflected by the refection surface of the rotary polygon mirror 205 being rotated enters the fθ lens 206 with an angle being continuously changed at a constant angular velocity. The light beam is condensed by the fθ lens 206, and is imaged on the surface of the photosensitive drum 102 as a light spot. The fθ lens 206 is configured to correct a distortion so as to guarantee temporal linearity of the scan, and hence the light spot is scanned on the surface of the photosensitive drum 102 in the main scanning direction indicated by the arrow X at a substantially constant speed.

(Light Source Drive Circuit)

Figure 3:
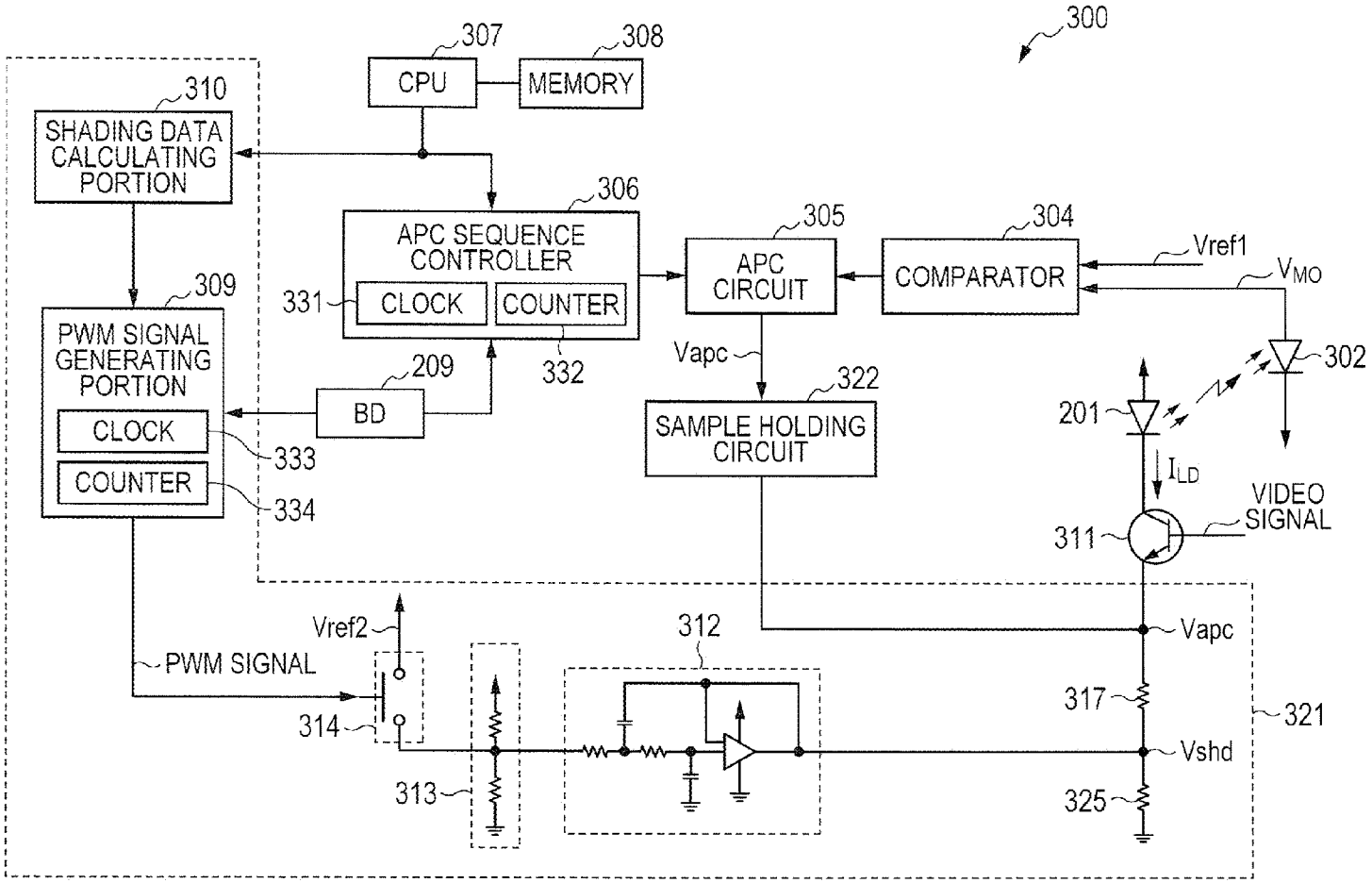
FIG. 3 is a diagram for illustrating a light source drive circuit according to the first embodiment.

Next, a light source drive circuit 300 will be described. FIG. 3 is a diagram for illustrating the light source drive circuit 300 according to the first embodiment. The light source drive circuit 300 serving as a light intensity controller configured to control the light intensity of the light beam output from the light source 201 is configured to execute the automatic light intensity control (hereinafter referred to as "APC") and the shading correction control. The light source drive circuit 300 is configured to execute the APC at a timing based on a BD signal output from the BD 209 while the light beam is being scanned on the non-image forming area. The light source drive circuit 300 is further configured to execute the shading correction control while the light beam is being scanned on the image forming area based on a scan position of the light beam (exposure position of the light beam in the scanning direction). The light source drive circuit 300 includes a CPU 307, a memory (storage unit) 308, a comparator 304, an APC circuit 305, an APC sequence controller 306, a sample holding circuit 322, a light source drive portion 311, and a shading circuit 321. The shading circuit 321 includes a shading data calculating portion 310, a PWM signal generating portion 309, a voltage switch 314, a smoothing circuit 312, and a resistor 317.

(Automatic Light Intensity Control)

Next, an operation of the APC executed by the APC circuit 305 while the light beam is being scanned on the non-image forming area will be described. The PD 302 detects the rear beam emitted from the light source 201. The APC circuit 305 controls the value of a drive current $I_{LD}$ to be supplied to the light source 201 based on the detection result of the light intensity obtained by the PD 302 so that the light intensity detected by the PD 302 becomes a target light intensity. The PD 302 outputs a monitor voltage $V_{MO}$ based on the light intensity of the rear beam. The monitor voltage $V_{MO}$ is compared with an APC reference voltage Vref1 being a voltage corresponding to the target light intensity by the comparator 304. The APC circuit 305 outputs a light intensity control voltage (hereinafter referred to as "Vapc") based on a comparison result output from the comparator 304. The voltage Vapc is input to the shading circuit 321. In the APC, the APC circuit 305 adjusts the APC control voltage Vapc so that the monitor voltage $V_{MO}$ output from the PD 302 becomes equal to the APC reference voltage Vref1. The APC control voltage Vapc is held in the sample holding circuit 322.

By the APC, the drive current $I_{LD}$ flowing into the light source 201 is automatically adjusted so that the light intensity of the light beam detected by the PD 302 becomes the target light intensity. The operation timing of the APC is determined by the APC sequence controller 306. The CPU 307 sets a count value for determining the operation timing of the APC in the APC sequence controller 306. The APC sequence controller 306 includes an internal clock 331 and a counter 332. The internal clock 331 serving as a clock signal generator is configured to generate a clock signal having a frequency higher than that of the BD signal (periodic signal) of the BD 209. The counter 332 performs a count operation for counting the clock signal generated by the internal clock 331 with the input timing of the BD signal from the BD 209 being used as a reference. The APC sequence controller 306 determines the operation timing of the APC based on the count value set by the CPU 307. The operation timing of the APC is determined so that the APC is performed while the light beam is being scanned on the non-image forming area. By the above-mentioned operation, the APC is executed in the non-image forming area, and the light intensity of the light beam emitted from the light source 201 is adjusted to a predetermined target value corresponding to the APC reference voltage Vref1.

Next, the drive current $I_{LD}$ for driving the light source 201 will be described. The drive current $I_{LD}$ is determined based on the APC control voltage Vapc, a shading voltage (output voltage) Vshd output from the smoothing circuit 312, a resistance value Rs of the resistor 317, and a resistance value Rt (Rt<<Rs) of a resistor 325.

$$I_{LD}=V\text{apc}/(Rs+Rt)-Vshd/Rt$$

The APC is executed in the non-image forming area during one scan period. The sample holding circuit 322 outputs the sampled voltage Vapc in the image forming area during the one scan period. Therefore, the voltage Vapc output by the sample holding circuit 322 in the image forming area during one scan period is fixed, and a current value Vapc/(Rs+Rt) is fixed.

Meanwhile, the shading circuit 321 described later controls the voltage Vshd according to the exposure position of the light beam in the main scanning direction. Therefore, a current value Vshd/Rt is changed according to the exposure position of the light beam in the main scanning direction in the image forming area during one scan period.

In the image forming area, the current value Vapc/(Rs+Rt) is fixed, and the current value Vshd/Rt is changed according to the exposure position of the light beam in the main scanning direction. Therefore, by controlling the voltage Vshd according to the exposure position of the light beam in the main scanning direction, it is possible to control the current $I_{LD}$ flowing into the light source 201 to a current value corresponding to the exposure position of the light beam in the main scanning direction.

(Shading Circuit)

Next, an operation of the shading circuit 321 serving as the light intensity controller will be described. The CPU 307 reads the correction value of the light intensity (light intensity correction data; hereinafter referred to as "shading data") corresponding to each exposure position from the memory 308. The CPU 307 inputs the shading data to the shading data calculating portion 310. The shading data calculating portion 310 serving as a correction value generator outputs the calculated shading data to the PWM signal generating portion 309. The calculation of the shading data will be described later. The PWM signal generating portion (pulse signal generator) 309 serving as an output unit outputs a PWM signal including a pulse having a pulse width (duty cycle) based on the shading data. In this case, the PWM signal generating portion 309 switches the shading data to be used for generating the PWM signal for each shading block during the scanning of the light beam. Then, the PWM signal generating portion 309 outputs the PWM signal having a pulse width corresponding to the shading block. The memory 308 has the image forming area divided into a predetermined number, and stores the shading data corresponding to each of the blocks (hereinafter referred to as "shading block") obtained through the division. The PWM signal generating portion 309 includes a reference clock signal generating portion (hereinafter referred to as "clock") 333 configured to generate a reference clock signal having a fixed frequency and a counter 334 configured to count the reference clock signal. The clock 333 serving as the clock signal generator generates the clock signal having a frequency higher than that of the BD signal (periodic signal) of the BD 209. The PWM signal generating portion 309 counts the reference clock signal with the BD signal being used as a reference by the internal counter 334, and switches the shading data at a count value corresponding to a boundary between the shading blocks. The PWM signal turns on or off the voltage switch 314. The shading data calculating portion 310 and the PWM signal generating portion 309 both serve as a setting unit. The setting unit sets the stored shading data and the calculated shading data according to the exposure position of the light beam in the main scanning direction while the light beam is being scanned on the image forming area of the photosensitive drum 102.

As illustrated in FIG. 3, a bias application circuit 313 is provided between the voltage switch 314 and the smoothing circuit 312. The bias application circuit 313 applies a bias voltage Vbias being a fixed voltage to the output from the voltage switch 314. When the voltage switch 314 is in an on state, input to the smoothing circuit 312 is Vref2+Vbias. The value of the bias voltage Vbias is a value extremely smaller than Vref2, and indicates a minute voltage higher than 0 V which has a value extremely closer to 0 V. When the voltage switch 314 is in an off state, the input to the smoothing circuit 312 is Vbias. Therefore, the input to the smoothing circuit 312 oscillates between Vref2+Vbias and Vbias when the voltage switch 314 is turned on or off by the PWM signal. The smoothing circuit 312 smooths the input, and outputs the shading voltage Vshd. The PWM signal generating portion 309 sets the duty cycle of the PWM signal for each shading block, and controls the shading voltage Vshd output from the smoothing circuit 312. The shading voltage Vshd is a voltage based on a shading reference voltage Vref2, the bias voltage Vbias, and the duty cycle of the PWM signal. With this operation, the drive current $I_{LD}$ is adjusted to execute the shading correction.

(Shading Correction Control)

Figure 4:
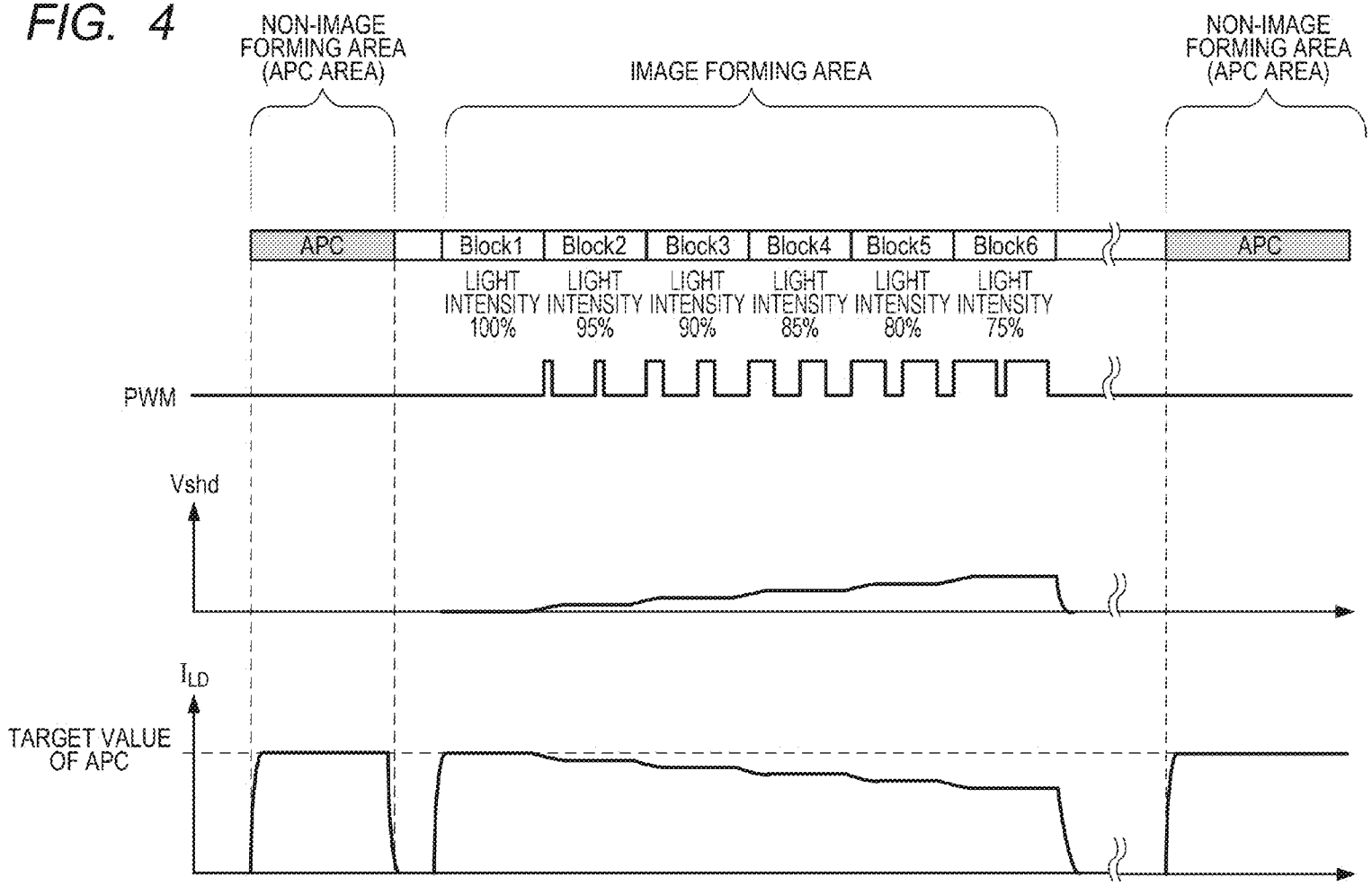
FIG. 4 is a timing chart for illustrating an operation of shading correction control according to the first embodiment.

Now, an operation of the shading correction control will be described. FIG. 4 is a timing chart for illustrating the operation of the shading correction control according to the first embodiment. In FIG. 4, a shading operation sequence during one scan is illustrated. In this sequence, the image forming area is divided into a plurality of blocks, and the duty cycle of the PWM signal is set based on the shading data for each block. As described above, the drive current $I_{LD}$ is controlled by the shading voltage Vshd. For example, as the pulse width of the PWM signal becomes larger, the shading voltage Vshd output from the smoothing circuit 312 becomes larger, and hence the drive current $I_{LD}$ becomes smaller, which causes the light intensity of the light beam to become lower. For example, in Block 1 illustrated in FIG. 4, the duty cycle of the PWM signal output by the PWM signal generating portion 309 is 0%. The light intensity exhibited at this time is assumed to be 100%. In Block 2, in order to control the light intensity at 95% of the light intensity in Block 1, the duty cycle of the PWM signal output by the PWM signal generating portion 309 is set to 5%. The PWM signal generating portion 309 outputs the PWM signal having a duty cycle of 5%, to thereby control the drive current $I_{LD}$ during a period for scanning the light beam on Block 2 and control the light intensity of the light beam at 95%. Similarly in blocks from Block 3 to Block 6, the PWM signal generating portion 309 outputs a PWM signal having a duty cycle corresponding to each block, to thereby be able to control the light intensity of the light beam at the light intensity corresponding to each block. In FIG. 4, the PWM signal in each block is expressed as one pulse, but in actuality, the PWM signal generating portion 309 generates a plurality of pulses in each block, and the smoothing circuit 312 subjects the plurality of pulses to smoothing processing.

The smoothing circuit 312 smooths the input, to thereby output the shading voltage Vshd and smoothly change the light intensity between the shading blocks in the above-mentioned sequence. The smoothing circuit 312 is a filter circuit including an active filter. The active filter includes a capacitor and a choke coil or a resistor and uses an operational amplifier. A cutoff frequency of the active filter is set so as to cut the frequency of the PWM signal and to pass the period of the shading block. At a switching timing (timing for switching the shading block) of the pulse width of the PWM signal, the voltage Vshd is changed in a curved line without having a step difference owing to the operation of the smoothing circuit 312. That is, the light intensity is inhibited from being extremely changed at the switching timing of the pulse width of the PWM signal with use of the smoothing circuit 312, to thereby be able to prevent streak or unevenness from occurring on an image.

(Shading Data Calculation)

Next, a method of calculating the shading data corresponding to a scan speed will be described. The scan speed is a speed for scanning the light beam on the surface of the photosensitive drum 102 in the main scanning direction. The scan speed is set based on the image forming speed of the image forming apparatus 120. The image forming apparatus 120 can operate at a plurality of image forming speeds.

When receiving a print command, the CPU 307 serving as a scan speed setting unit stores the image forming speed of each page, which is determined based on image formation conditions including the sheet type and the image quality input through an operation portion by a user, into the memory 308. The CPU 307 functions as a speed switching unit configured to switch the image forming speed of the image forming apparatus 120 among the plurality of image forming speeds depending on the image forming speed of each page, which is stored in the memory 308. When the image forming speed is changed depending on a change in image formation conditions including the sheet type and the image quality, the scan speed is changed depending on the change in image forming speed. In the following, a method of calculating shading data for a second scan speed from shading data for a first scan speed by the shading data calculating portion 310 will be described. The image forming apparatus 120 may be an apparatus configured to form an image by selectively setting one scan speed from among three or more scan speeds. In that case, the shading data calculating portion 310 calculates the shading data for the second scan speed and shading data for a third scan speed from the shading data for the first scan speed.

Figure 5:
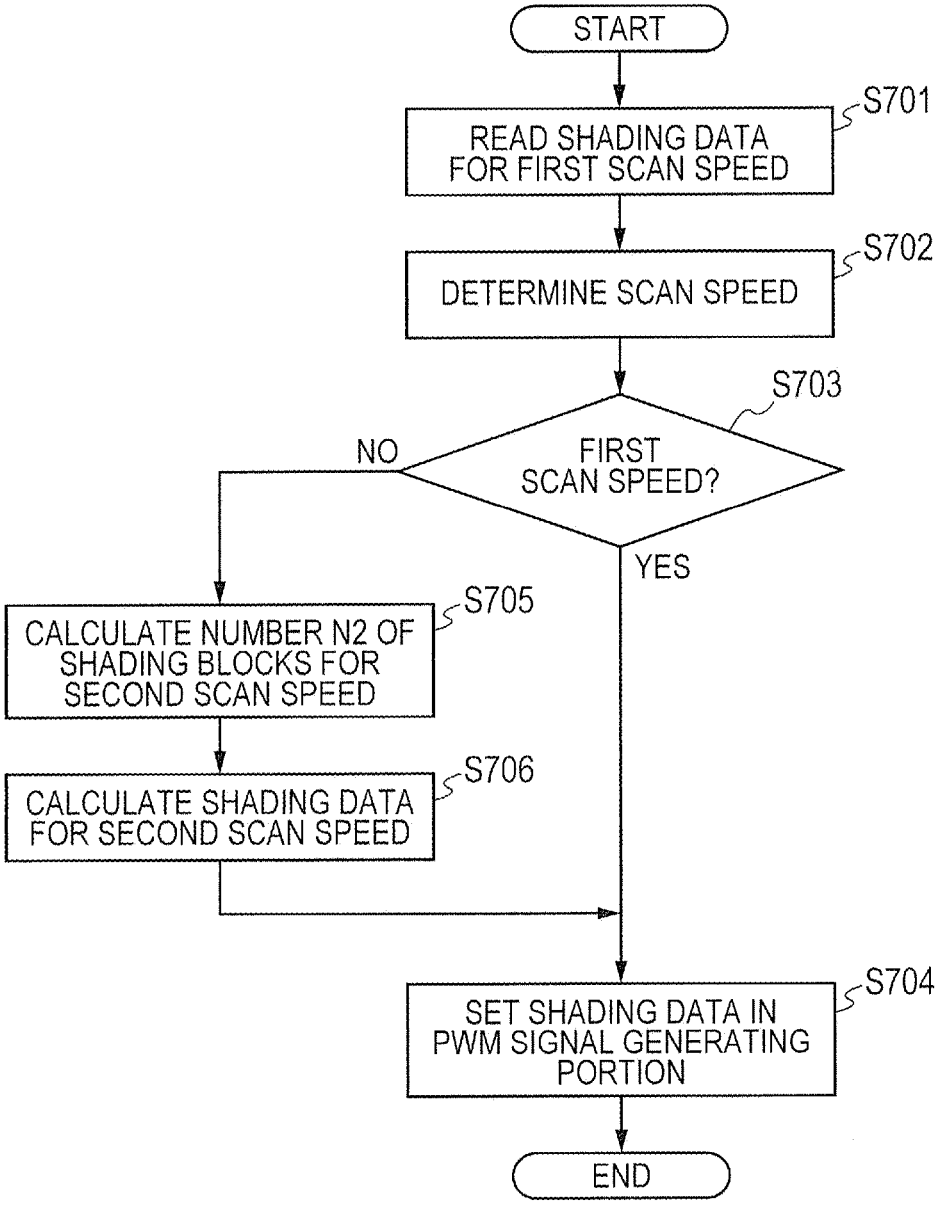
FIG. 5 is a flowchart for illustrating shading data calculation according to the first embodiment.

FIG. 5 is a flowchart for illustrating shading data calculation according to the first embodiment. The CPU 307 executes the shading data calculation based on a program stored in the memory 308. In the embodiment, the image forming apparatus 120 operates at the first scan speed (first scan speed mode) and the second scan speed (second scan speed mode). The first scan speed is set in a plain paper mode. The second scan speed is set in a thick paper mode. The second scan speed is lower than the first scan speed. The memory 308 stores in advance shading conditions including shading data (storage values) D1 to D10 for the first scan speed, the number N of shading blocks, and a scan time Ts. The shading data is a correction value for the shading correction for the light intensity of the light beam corresponding to the exposure position on the photosensitive drum 102 in the main scanning direction. When receiving a print command, the CPU 307 starts the shading data calculation. The shading data calculation is executed for each page before the image formation is started. When the scan speeds of all the pages of a print job are the same, the shading data calculation may be executed only before the image formation of the first page of the print job. The CPU 307 reads the shading data D1 to D10 for the first scan speed which are stored in the memory 308 (S701), and inputs the shading data D1 to D10 to the shading data calculating portion 310. The CPU 307 serving as a speed determining unit determines the scan speed of the relevant page based on information included in the print command (S702). The CPU 307 inputs the determined scan speed to the shading data calculating portion 310.

Figure 6A:
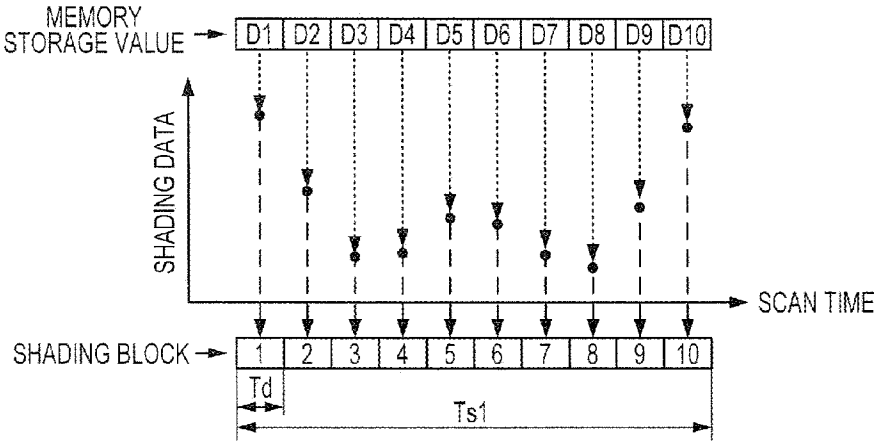
FIG. 6A, FIG. 6B, and FIG. 6C are explanatory diagrams of the shading data calculation according to the first embodiment.
Figure 6B:
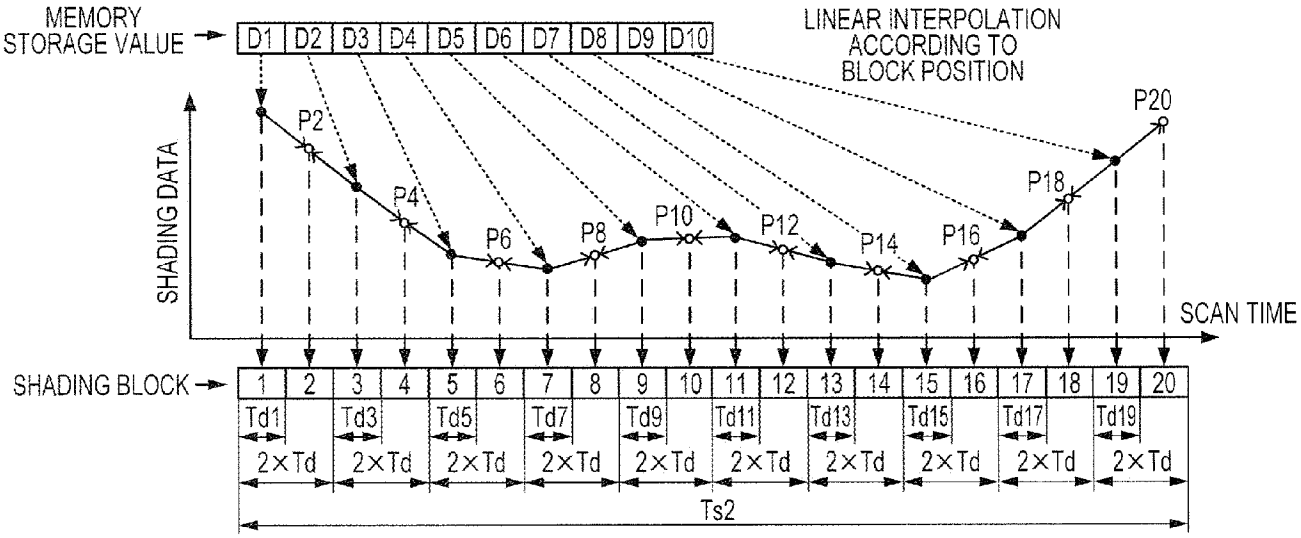
Figure 6C:
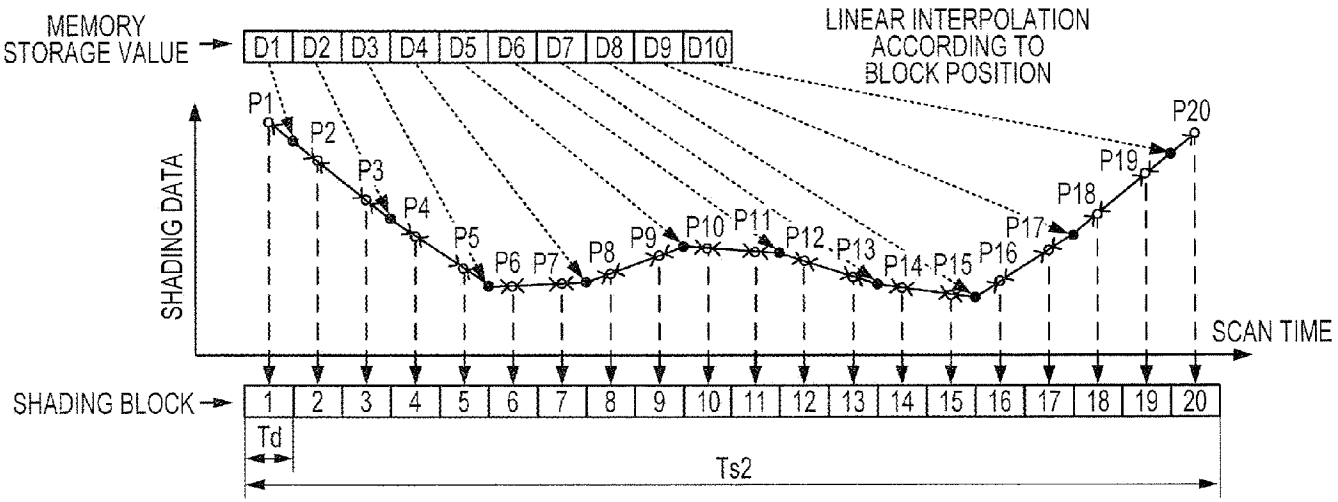

The CPU 307 causes the shading data calculating portion 310 to determine whether or not the determined scan speed is the first scan speed (S703). When the determined scan speed is the first scan speed (YES in S703), the shading data calculating portion 310 sets the shading data D1 to D10 for the first scan speed, which are stored in advance in the memory 308, in the PWM signal generating portion 309 (S704). The CPU 307 finishes the shading data calculation. FIG. 6A, FIG. 6B, and FIG. 6C are explanatory diagrams of the shading data calculation according to the first embodiment. FIG. 6A is the explanatory diagram for illustrating a relationship between the shading data and the shading blocks set in the PWM signal generating portion 309 in the case of the first scan speed. In the embodiment, as an example, in the case of the first scan speed, the number N1 of shading blocks is assumed to be 10, and the one scan time Ts1 for a shading correction area in the main scanning direction is assumed to be 300 μs. The memory 308 stores 10 shading data D1 to D10 for the first scan speed. The shading data D1 to D10 are set in the PWM signal generating portion 309 in association with the shading blocks 1 to 10 on a one-to-one basis. The cutoff frequency of the smoothing circuit 312 is set so that the number N1 of shading blocks becomes 10 at the first scan speed. A period Td of the PWM signal to be input to the smoothing circuit 312 is set in advance based on the cutoff frequency of the smoothing circuit 312, and is stored in the memory 308. The period Td is a fixed switching period for switching the shading data.

Figure 7A:
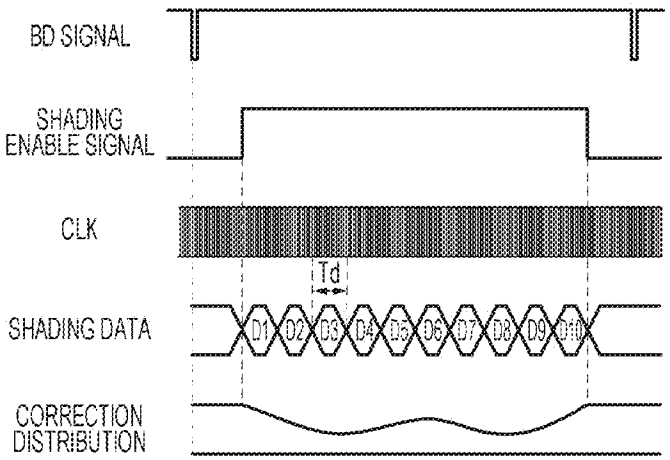
FIG. 7A, FIG. 7B, and FIG. 7C are diagrams for illustrating shading data and a correction distribution according to the first embodiment.
Figure 7B:
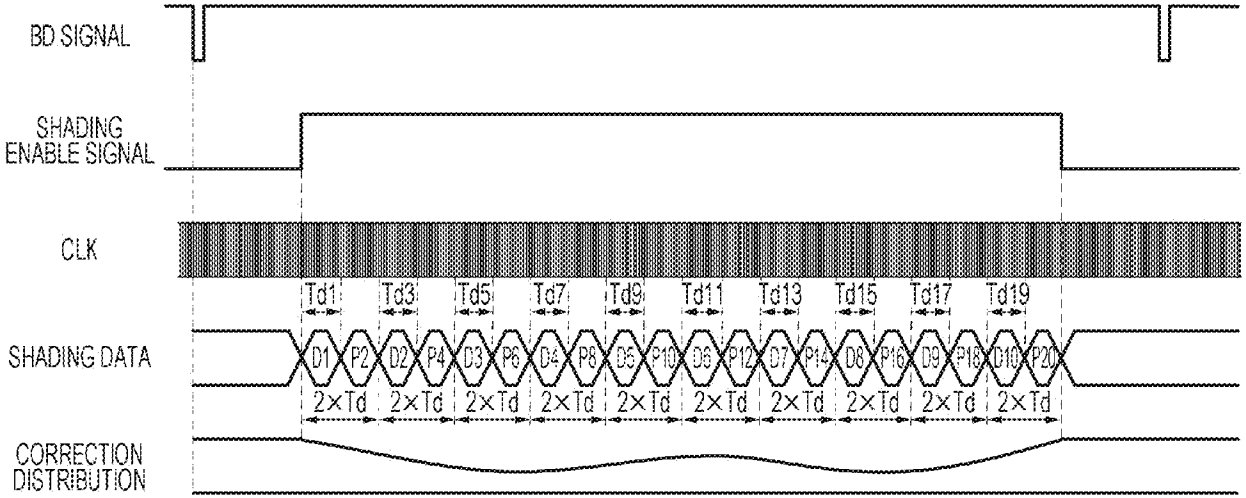
Figure 7C:
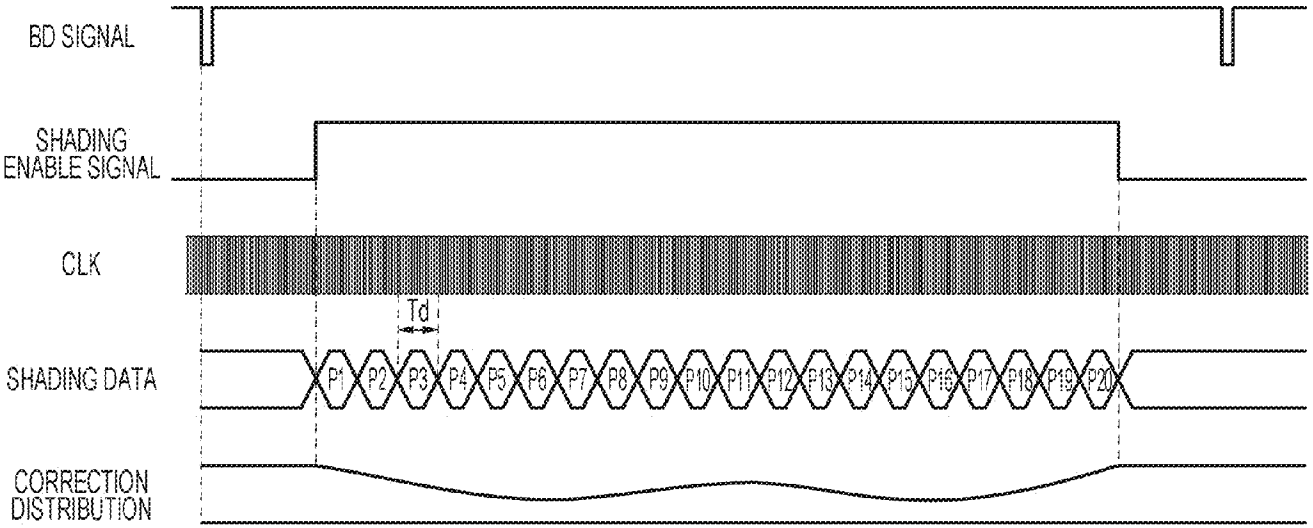

FIG. 7A, FIG. 7B, and FIG. 7C are diagrams for illustrating the shading data and a correction distribution according to the first embodiment. FIG. 7A, FIG. 7B, and FIG. 7C are illustrations of read timings of the shading data during one scan of the light beam in the main scanning direction. FIG. 7A is the illustration of the reading of the shading data for the first scan speed and the correction distribution. The switching timing of the shading data is defined by counting pulses of a clock signal CLK with the same frequency between the scan speeds. When receiving a shading enable signal, the PWM signal generating portion 309 reads the shading data D1 to D10 based on the clock signal CLK to generate a PWM signal. The shading data D1 to D10 are read every pulse count of the clock signal CLK corresponding to the period Td of the PWM signal. In the embodiment, the shading data D1 to D10 are read every 10,000 pulses to generate the PWM signal. The PWM signal has the duty cycle set based on the shading data D1 to D10. The correction distribution represents a distribution of the shading voltage Vshd output from the smoothing circuit 312 to which the generated PWM signal has been input. As illustrated in FIG. 7A, the distribution of the shading voltage Vshd (correction distribution) is smoothed.

Referring back to FIG. 5, when the determined scan speed is not the first scan speed (NO in S703), the CPU 307 causes the shading data calculating portion 310 to execute the shading data calculation in the following manner. The image forming apparatus 120 operates at the first scan speed and the second scan speed, and hence when the determined scan speed is not the first scan speed (NO in S703), the determined scan speed is the second scan speed. In the embodiment, the second scan speed is assumed to be ½ (half speed) of the first scan speed. FIG. 6B is the explanatory diagram for illustrating a relationship between the shading data and the shading blocks set in the PWM signal generating portion 309 in the case of the second scan speed. In the case of the second scan speed of the embodiment, as an example, the one scan time Ts2 for the shading correction area in the main scanning direction is 600 μs. The CPU calculates the number N2 of shading blocks for the second scan speed by the following expression (S705).

$$N2=N1\times(Ts2+Ts1)=10\times(600\times300)=20$$

When the number N2 of shading blocks is calculated, the shading data adequate for the number N2 of shading blocks for the second scan speed are calculated based on the shading data D1 to D10 for the first scan speed (S706). In the embodiment, the shading data D1, D2, D3, D4, D5, D6, D7, D8, D9, and D10 for the first scan speed, which are stored in the memory 308, are assigned to the shading blocks 1, 3, 5, 7, 9, 11, 13, 15, 17, and 19, respectively. A shading data P2 of the shading block 2 is calculated by linear interpolation based on the shading data D1 and D2 of the shading blocks 1 and 3, respectively. A shading data P4 of the shading block 4 is calculated by linear interpolation based on the shading data D2 and D3 of the shading blocks 3 and 5, respectively. Subsequently, shading data P6, P8, P10, P12, P14, P16, and P18 of the shading blocks 6, 8, 10, 12, 14, 16, and 18, respectively, are calculated in the same manner. A shading data P20 of the shading block 20 located outside the shading data D10 is calculated by linear approximation (extrapolation) with use of an inclination obtained from the shading data P18 and D10 of the shading blocks 18 and 19, respectively. In this manner, the shading data D1, P2, D2, P4, D3, P6, D4, P8, D5, P10, D6, P12, D7, P14, D8, P16, D9, P18, D10, and P20 of the shading blocks 1 to 20, respectively, are calculated. The shading data is calculated by the interpolation for a part of the shading blocks, but may be calculated by interpolation for all the shading blocks. The shading data calculating portion 310 sets the shading data for the calculated second scan speed in the PWM signal generating portion 309 (S704). The CPU 307 finishes the shading data calculation.

FIG. 7B is the illustration of the reading of the shading data for the second scan speed and the correction distribution. In regard to the shading data D1, D2, D3, . . . , and D10 during one scan period of the light beam in the main scanning direction, the shading data is switched every 10,000×α pulses of the clock signal CLK. In this case, a is a speed ratio of the first scan speed V1 to the second scan speed V2 (α=V1/V2). In the embodiment, the speed ratio α is 2. Therefore, the PWM signal generating portion 309 reads the shading data D1, D2, D3, . . . , and D10 from the memory 308 at a period of 2×Td to generate a PWM signal. The calculated interpolation shading data P2, P4, P6, P8, P10, P12, P14, P16, P18, and P20 are set between the shading data D1, D2, D3, . . . , and D10, respectively. A switching timing from the shading data D1 of the shading block 1 to the shading data P2 of the shading block 2 may differ between the scan speeds. The switching timing to the shading data P2 of the shading block 2 falls between the shading data D1 and the shading data D2. The switching timing is the period Td for the first scan speed, and is the period Td1 for the second scan speed. A switching timing from the shading data D2 to the interpolation shading data P4 is the period Td3. In the same manner, switching timings from the shading data D3, D4, . . . , and D10 to the interpolation shading data P6, P8, . . . , and P20 are the periods Td5, Td7, . . . , and Td19, respectively. The periods Td1, Td3, . . . , and Td19 are stored in advance in the memory 308. In the embodiment, the periods Td1, Td3, . . . , and Td19 are different, but may be the same. In the embodiment, every time the pulse count of the clock signal CLK set for each shading block elapses, the shading data is read to generate the PWM signal. The PWM signal generating portion 309 functions as a read timing switching unit configured to switch the timing for reading the shading data. As illustrated in FIG. 7B, the distribution of the shading voltage Vshd (correction distribution) is smoothed.

In the embodiment, the pulse count of the clock signal CLK of the shading block may differ for every shading block, and the interpolation shading data does not necessarily need to be calculated for each shading block. According to the embodiment, the shading data for the second scan speed does not need to be stored in advance in the memory 308, and hence the capacity of the memory 308 can be reduced. It is also possible to reduce a calculation load on the shading data calculating portion 310.

Figure 14A:
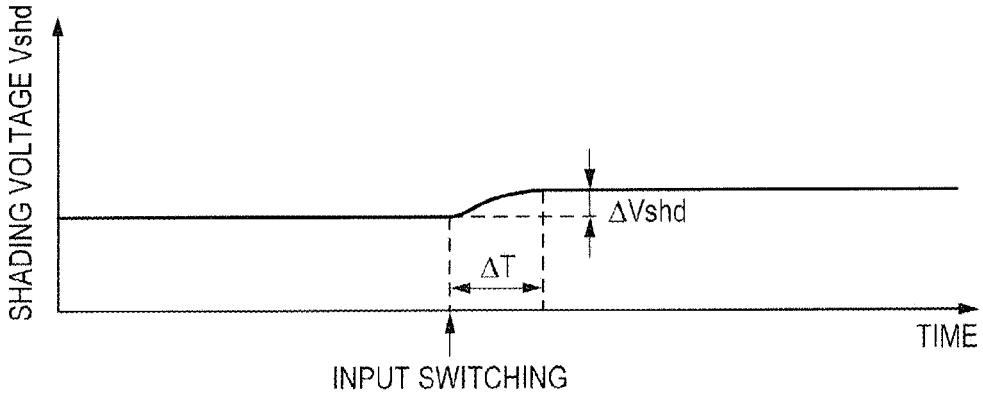
FIG. 14A, FIG. 14B, and FIG. 14C are explanatory diagrams of a relationship between a change time of a shading voltage and a distance of a change amount of a light intensity on a surface of a photosensitive drum.
Figure 14B:
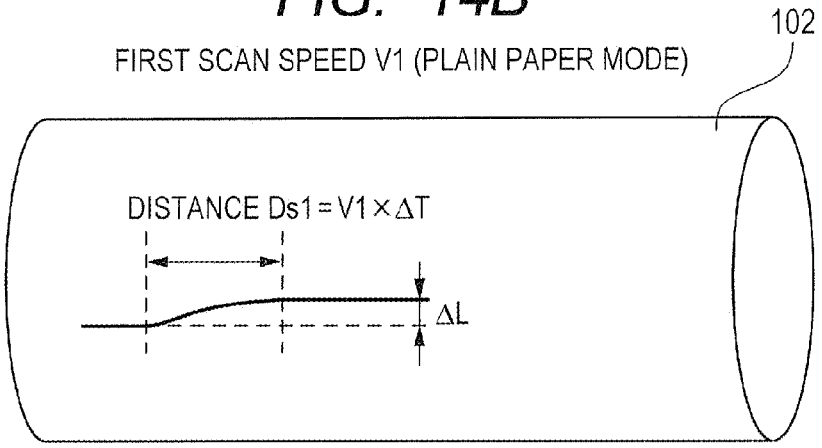
Figure 14C:
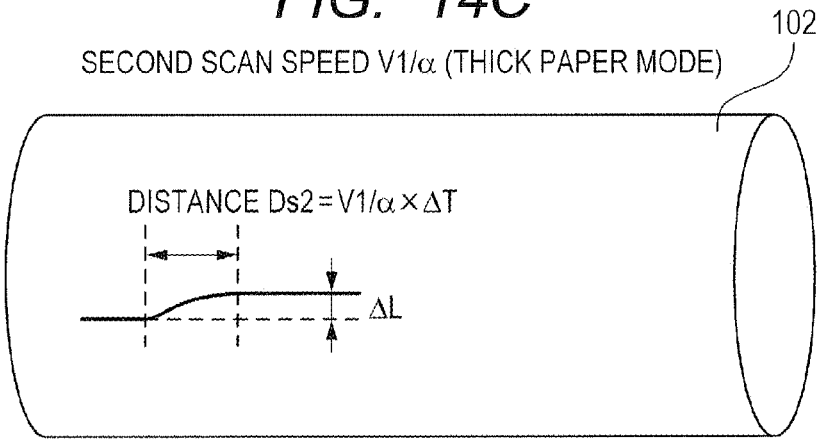

Now, the reason that the shading data calculating portion 310 generates the interpolation shading data P1 to P20 will be described. When the period Td, namely, the pulse width, of the PWM signal to be input to the smoothing circuit 312 is changed, the shading voltage Vshd to be output from the smoothing circuit 312 is changed. FIG. 14A, FIG. 14B, and FIG. 14C are explanatory diagrams of relationship between a change time ΔT of the shading voltage Vshd and a distance Ds of a change amount ΔL of a light intensity on the surface of the photosensitive drum 102. FIG. 14A is an illustration of the change time ΔT and a change amount ΔVshd of the shading voltage Vshd. After the shading block is switched to change the duty cycle of the PWM signal to be input to the smoothing circuit 312, the shading voltage Vshd is changed by the change amount ΔVshd during the change time ΔT associated with a filter constant of the smoothing circuit 312. FIG. 14B is an illustration of the change amount ΔL of the light intensity on the surface of the photosensitive drum 102 for the first scan speed V1 (plain paper mode) and the distance Ds1. When the shading voltage Vshd is changed by the change amount ΔVshd, the light intensity on the surface of the photosensitive drum 102 is changed by the change amount ΔL. The distance Ds1 by which the light beam is moved in the main scanning direction during the change time ΔT for changing the light intensity by the change amount ΔL is (first scan speed V1)×(change time ΔT). FIG. 14C is an illustration of the change amount ΔL of the light intensity on the surface of the photosensitive drum 102 for the second scan speed V1/α (thick paper mode) and the distance Ds2. The change amount ΔL of the light intensity per change time ΔT for the second scan speed V1/α is the same as the change amount ΔL of the light intensity per change time ΔT for the first scan speed V1. The distance Ds2 by which the light beam is moved in the main scanning direction during the change time ΔT for changing the light intensity by the change amount ΔL is (second scan speed V1/α)×(change time ΔT) where a represents a speed ratio of the first scan speed V1 to the second scan speed. The second scan speed V1/α is lower than the first scan speed V1.

The second scan speed V1/α is lower than the first scan speed V1, and hence the distance Ds2 by which the light beam is moved in the main scanning direction during the change time ΔT is shorter than the distance Ds1. Therefore, the change amount of the light intensity per unit distance for the second scan speed V1/α is larger than the change amount of the light intensity per unit distance for the first scan speed V1. When the change amount of the light intensity per unit distance is changed, the shading correction cannot be adequately performed, which causes an image failure that appears to be a step difference. In view of this, in the first embodiment and a second embodiment of the present invention described later, the number N of shading blocks is changed depending on the change of the scan speed to generate the interpolation shading data. By generating the interpolation shading data, it is possible to decrease the value of the change amount ΔL/(V1/α×ΔT) of the light intensity per unit distance for the second scan speed.

(Another Example of Shading Data Calculation)

In the embodiment, all the shading data for the second scan speed may be obtained by the shading data calculation. FIG. 6C is the explanatory diagram for illustrating a relationship between the shading data and the shading blocks set in the PWM signal generating portion 309 in the case of the second scan speed. In the same manner as described above, assuming that the one scan time Ts2 for the shading correction area in the main scanning direction is 600 μs in the case of the second scan speed, the number N2 of shading blocks for the second scan speed is 20 (S705).

When the number N2 of shading blocks is calculated, a relationship between each shading block and the exposure position in the main scanning direction becomes apparent from a relationship between the second scan speed and the period Td of the PWM signal. Subsequently, the shading data adequate for the number N2 of shading blocks for the second scan speed is calculated based on the shading data D1 to D10 for the first scan speed (S706). In the embodiment, the linear interpolation is performed on the shading data D1 to D10 for the first scan speed stored in the memory 308, to thereby calculate the shading data P2 to P19 of the shading blocks 2 to 19, respectively, for the second scan speed. As illustrated in FIG. 6C, the shading data P1 and P20 corresponding to the shading blocks 1 and 20, respectively, for the second scan speed are data located outside the shading data D1 to D10 stored in the memory 308. Therefore, an inclination that can be obtained from the shading data P2 and P3 of the shading blocks 2 and 3, respectively, is used to obtain the shading data P1 of the shading block 1 by the linear approximation (extrapolation). The shading data P20 of the shading block 20 is also obtained by linear approximation (extrapolation) with use of an inclination obtained from the shading data P18 and P19 of the shading blocks 18 and 19, respectively. The method of calculating the shading data for the second scan speed is not limited thereto. For example, the shading data calculation for the second scan speed may be executed after an approximate function of the shading data D1 to D10 stored in the memory 308 is obtained by, for example, a method of least squares. The shading data calculating portion 310 sets the shading data P1 to P20 for the calculated second scan speed in the PWM signal generating portion 309 (S704).

FIG. 7C is the illustration of the reading of the shading data for the second scan speed and the correction distribution. In regard to the shading data P1 to P20 during one scan period of the light beam in the main scanning direction, the shading data is switched every 10,000 pulses of the clock signal CLK corresponding to the period Td. The PWM signal generating portion 309 reads the calculated shading data P1 to P20 at the period Td to generate a PWM signal. The correction distribution represents a distribution of the shading voltage Vshd output from the smoothing circuit 312 to which the generated PWM signal has been input. As illustrated in FIG. 7C, the distribution of the shading voltage Vshd (correction distribution) is smoothed.

The embodiment has been described by assuming the case where the second scan speed is lower than the first scan speed. However, also in a case where the second scan speed is higher than the first scan speed, the shading data calculation can be executed in the same manner based on the flowchart of FIG. 5 described in the embodiment. When the memory 380 stores a shading data for the lowest scan speed, a shading data located outside the shading data stored in the memory 308 does not need to be calculated in the shading data calculation for another scan speed. Therefore, all the shading data for another scan speed can be obtained by the linear interpolation.

According to the embodiment, the shading data for the second scan speed can be obtained through the calculation based on the shading data for the first scan speed. Therefore, the shading correction for the second scan speed can be executed based on the shading data for the first scan speed. Further, the shading data for the second scan speed can be obtained through the calculation, and the switching timing of the shading data for the second scan speed can be caused to differ from the switching timing of the shading data for the first scan speed. Accordingly, the shading correction can be executed more satisfactorily.

Second Embodiment

Next, with reference to FIG. 8, FIG. 9, FIG. 10A, and FIG. 10B, the second embodiment will be described. In the second embodiment, like configurations as those of the first embodiment are denoted by like reference symbols to omit the description thereof. The image forming apparatus 120, the light scanning device 101, and the light source drive circuit 300 of the second embodiment are similar to those of the first embodiment, and hence description thereof is omitted herein. The second embodiment is different from the first embodiment in that the shading data is expressed as a function of an exposure position "x" in the shading data calculation. The function is an approximate expression obtained by approximating the shading data. The memory 308 stores coefficients of the approximate expression of the shading data. The image forming apparatus 120 according to the second embodiment is configured to calculate the shading data for each scan speed based on the approximate expression of the shading data. With this configuration, it is possible to reduce an error between different scan speeds due to the linear approximation or the method of least squares performed on the shading data, and to also reduce a usage amount of the memory 308.

Figure 8:
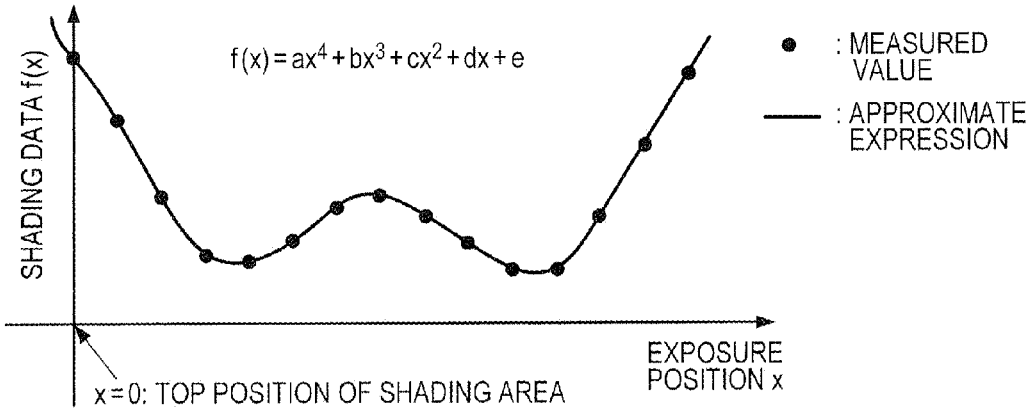
FIG. 8 is a graph for showing the shading data relative to an exposure position according to a second embodiment.

FIG. 8 is a graph for showing shading data f(x) relative to the exposure position "x" according to the second embodiment. As shown in FIG. 8, a quartic approximate expression is obtained for multipoint data measured in advance. The quartic approximate expression of the shading data f(x) is as follows.

$$f(x)=ax^4+bx^3+cx^2+dx+e$$

The coefficients "a", "b", "c", "d", and "e" of the approximate expression of the shading data f(x) are stored in the memory 308.

Figure 9:
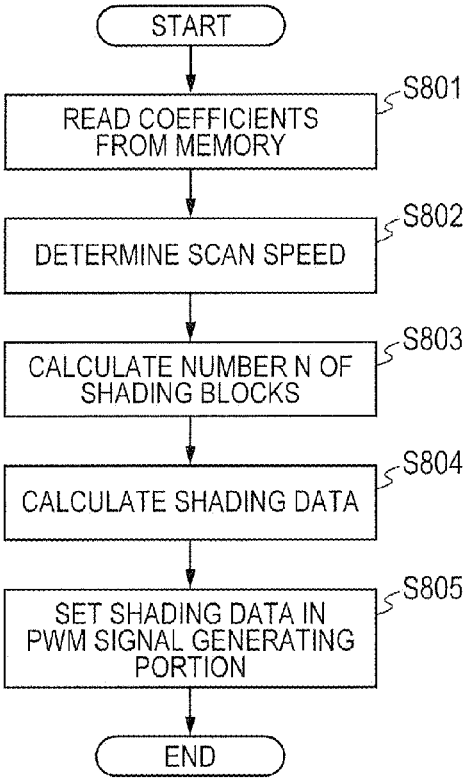
FIG. 9 is a flowchart for illustrating shading data calculation according to the second embodiment.

FIG. 9 is a flowchart for illustrating shading data calculation according to the second embodiment. The CPU 307 executes the shading data calculation based on a program stored in the memory 308. In the embodiment, the image forming apparatus 120 operates at a plurality of scan speeds. When receiving a print command, the CPU 307 starts the shading data calculation. The shading data calculation is executed for each page before the image formation is started. When the scan speeds of all the pages of a print job are the same, the shading data calculation may be executed only before the image formation of the first page of the print job. The CPU 307 reads the coefficients "a", "b", "c", "d", and "e" of the approximate expression of the shading data f(x) which are stored in the memory 308 (S801). The CPU 307 inputs the coefficients "a", "b", "c", "d", and "e" to the shading data calculating portion 310. The CPU 307 causes the shading data calculating portion 310 to determine the scan speed of the relevant page based on information included in the print command (S802).

The shading data calculating portion 310 determines the one scan time Ts for the shading correction area in the main scanning direction for the determined scan speed. The memory 308 may store the one scan time Ts for the shading correction area in the main scanning direction corresponding to the scan speed. The shading data calculating portion 310 calculates the number N of shading blocks for the determined scan speed by the following expression with use of the one scan time Ts and the period Td of the PWM signal to be input to the smoothing circuit 312 (S803).

$$Nn=Tsn/Tdn$$

In this expression, "n" represents an n-th scan speed.

The shading data calculating portion 310 calculates the shading data corresponding to the exposure position "x" by the following approximate expression with use of a determined scan speed Vn, the period Tdn of the PWM signal, and the coefficients "a", "b", "c", "d", and "e" (S804).

$$f(t_m)=at_m^4+bt_m^3+ct_m^2+dt_m+e$$

$$t_m=Vn\times Tdn\times(m-1)$$

In the expressions, $t_m$ represents a scan time indicating the exposure position "x" in the main scanning direction, and "m" represents the number assigned to a shading data block. For example, assuming that the number N1 of shading blocks for the first scan speed V1 is 10, the number "m" assigned to the shading data block is an integer of from 1 to 10 (110). At a rising edge of the shading enable signal, the scan time $t_m$ is 0 (zero) ($t_m$=0). The scan time $t_m$ represents a time period from the rising edge of the shading enable signal for each scan speed Vn until the start of each shading block "m". The shading data $f(t_m)$ represents a correction amount for each shading block "m" for each scan speed Vn. The CPU 307 sets the shading data $f(t_m)$ ("m" represents an integer of from 1 to N, and N represents the number of shading blocks) calculated based on the approximate expression in the PWM signal generating portion 309 (S805). The CPU 307 finishes the shading data calculation.

Figure 10A:
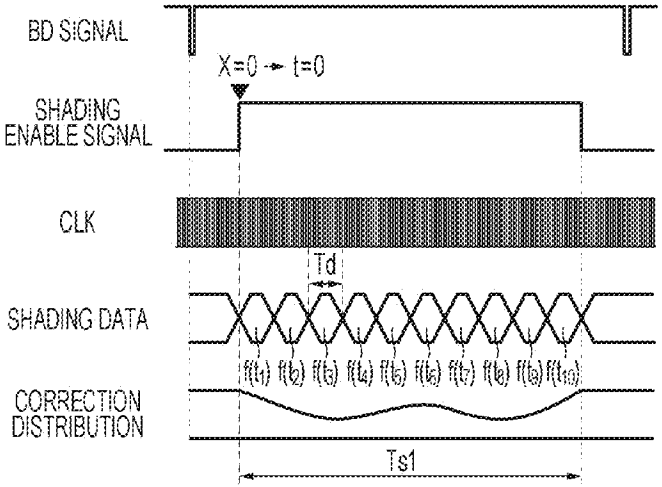
FIG. 10A and FIG. 10B are diagrams for illustrating shading data and a correction distribution according to the second embodiment.
Figure 10B:
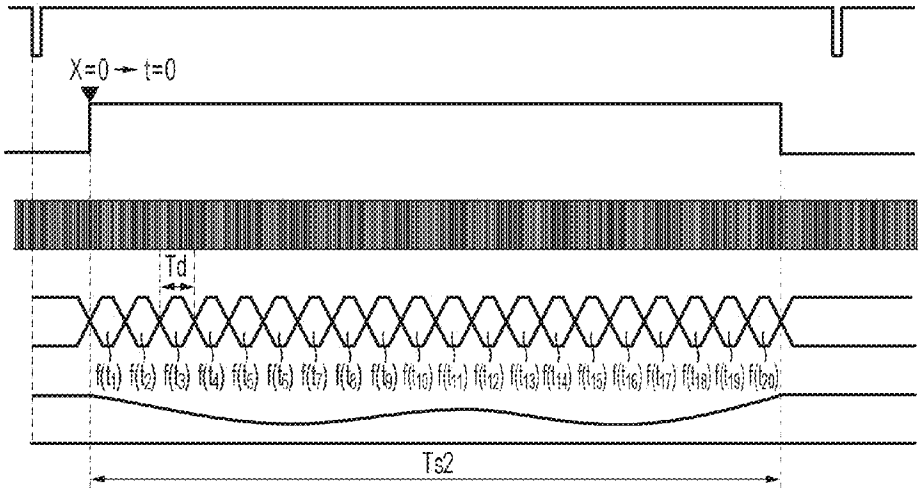

FIG. 10A and FIG. 10B are diagrams for illustrating shading data and a correction distribution according to the second embodiment. FIG. 10A is an illustration of the case of the first scan speed V1. The number N1 of shading blocks for the first scan speed V1 is set to 10 (N1=10). Shading data $f(t_1)$ to $f(t_{10})$ are set in the PWM signal generating portion 309 in association with the shading blocks 1 to 10, respectively. The shading blocks 1 to 10 correspond to the exposure position "x" in the main scanning direction. As illustrated in FIG. 10A, the shading data $f(t_1)$ to $f(t_{10})$ are read from the PWM signal generating portion 309 every pulse count (for example, every 10,000 pulses) of the clock signal CLK corresponding to the period Td of the PWM signal. The PWM signal generating portion 309 generates a PWM signal having the duty cycle set based on the shading data $f(t_1)$ to $f(t_{10})$. The PWM signal is input to the smoothing circuit 312. The correction distribution represents a distribution of the shading voltage Vshd output from the smoothing circuit 312 to which the generated PWM signal has been input. As illustrated in FIG. 10A, the distribution of the shading voltage Vshd (correction distribution) is smoothed.

FIG. 10B is an illustration of the case of the second scan speed V2. The number N2 of shading blocks for the second scan speed V2 is set to 20 (N2=20). The shading data $f(t_1)$ to $f(t_{10})$ and shading data $f(t_{11})$ to $f(t_{20})$ are set in the PWM signal generating portion 309 in association with the shading blocks 1 to 20, respectively. The shading blocks 1 to 20 correspond to the exposure position "x" in the main scanning direction. As illustrated in FIG. 10B, the shading data $f(t_1)$ to $f(t_{20})$ are read from the PWM signal generating portion 309 every pulse count (for example, every 10,000 pulses) of the clock signal CLK corresponding to the period Td of the PWM signal. The PWM signal generating portion 309 generates a PWM signal having the duty cycle set based on the shading data $f(t_1)$ to $f(t_{20})$. As illustrated in FIG. 10B, the distribution of the shading voltage Vshd (correction distribution) is smoothed.

According to the embodiment, the coefficients "a", "b", "c", "d", and "e" of the approximate expression of the shading data f(x) being the function of the exposure position "x" are stored in the memory 308. The exposure position "x" is converted into the scan time $t_m$ based on the scan speed Vn and the period Tdn of the PWM signal. In the embodiment, the period Tdn of the PWM signal is a fixed value set based on a specific constant of the smoothing circuit 312 regardless of the scan speed Vn. However, the period Tdn of the PWM signal may be changed depending on the scan speed Vn. Further, instead of the coefficients "a", "b", "c", "d", and "e" of the approximate expression of the shading data f(x) being the function of the exposure position "x", coefficients of an approximate expression of shading data f(t) being a function of the scan time t for a predetermined scan speed may be stored in the memory 308. The approximate expression of the shading data is not limited thereto, and may be another approximate expression. The approximate expression of the shading data f(x) in the image forming apparatus 120 according to the embodiment is a quartic equation, but the order is preferred to be changed depending on the distribution to be corrected, and does not necessarily need to be a quartic approximation. In the embodiment, an origin for the shading data calculation based on the approximate expression is set at a top position of the shading correction, but a method of setting the origin is not limited thereto. Further, the scan time $t_m$ is calculated with use of the period Td of the PWM signal, but the shading block may be switched with a predetermined trigger being used as a reference. For example, the BD signal may be used as a reference to switch the shading block every predetermined clock count starting from the BD signal.

According to the second embodiment, the shading data $f(t_m)$ for each scan speed Vn can be calculated based on the coefficients and "a", "b", "c", "d", "e" of the approximate expression of the shading data f(x) stored in the memory 308. With this configuration, it is possible to reduce a used area of the memory 308, and to reduce such an error due to the linear approximation for each scan speed as exhibited in the first embodiment. Accordingly, with use of an optical system and a circuit configuration that are inexpensive, the smoothing circuit 312 can perform the shading correction even for different scan speeds without impairing a desired smoothing effect, to thereby be able to suppress density unevenness.

Third Embodiment

Next, with reference to FIG. 11, FIG. 12, FIG. 13A, and FIG. 13B, a third embodiment of the present invention will be described. In the third embodiment, like configurations as those of the first embodiment are denoted by like reference symbols to omit the description thereof. The image forming apparatus 120 and the light scanning device 101 of the third embodiment are similar to those of the first embodiment, and hence description thereof is omitted herein. In the first embodiment and the second embodiment, the number Nn of shading blocks is changed depending on the change of the scan speed Vn. In the third embodiment, the number N of shading blocks is fixed regardless of the change of the scan speed Vn. The switching timing of the shading block is changed depending on the change of the scan speed Vn.

(Light Source Drive Circuit)

Figure 11:
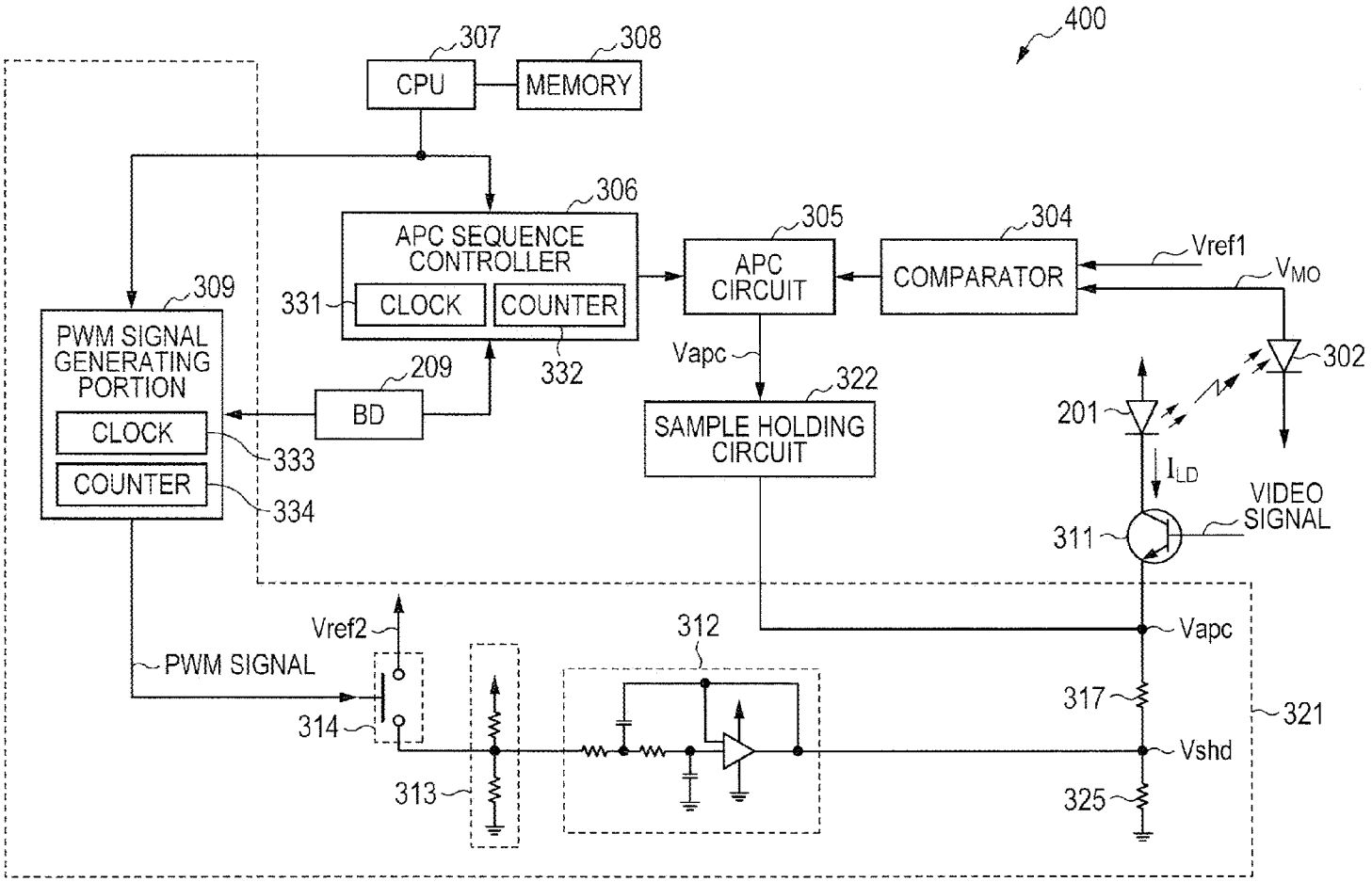
FIG. 11 is a diagram for illustrating a light source drive circuit according to a third embodiment.

FIG. 11 is a diagram for illustrating a light source drive circuit 400 according to the third embodiment. In the same manner as the light source drive circuit 300 of the first embodiment, the light source drive circuit 400 serving as the light intensity controller in the image forming apparatus 120 according to the third embodiment is configured to execute the APC and the shading correction control. The light source drive circuit 400 in the image forming apparatus 120 according to the third embodiment is different from the light source drive circuit 300 of the first embodiment in that the shading data calculating portion 310 is omitted. The CPU 307 is electrically connected to the PWM signal generating portion 309. When receiving a print command, the CPU 307 stores the image forming speed of each page, which is determined based on the image formation conditions including the sheet type and the image quality input through the operation portion by the user, into the memory 308. The memory 380 stores in advance the shading data D1 to D10 for the first scan speed V1 being the reference speed and the period Td being a reference timing. In the embodiment, the number N1 of shading blocks for the first scan speed V1 is set to 10.

(Switching Timing Calculation)

Figure 12:
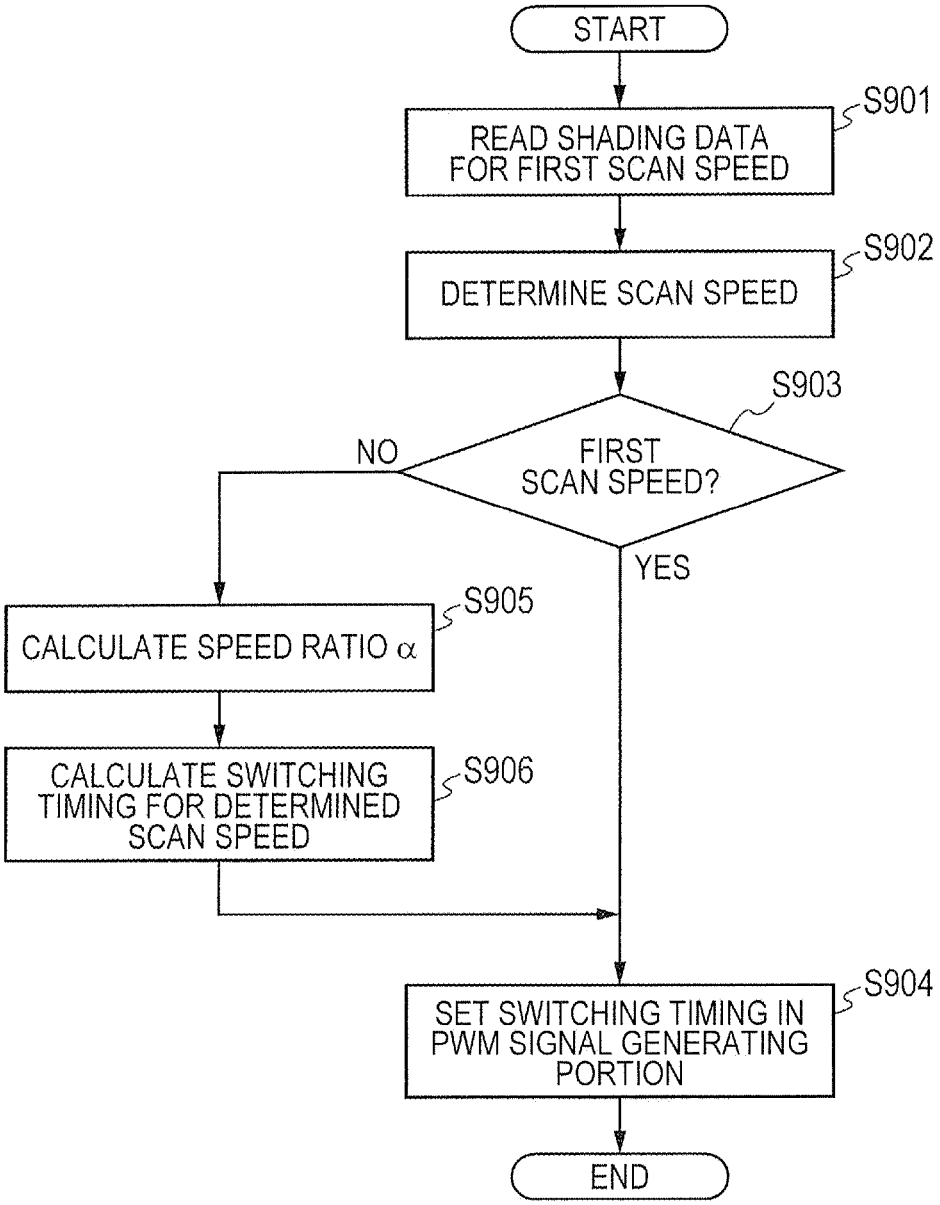
FIG. 12 is a flowchart for illustrating switching timing calculation according to the third embodiment.

FIG. 12 is a flowchart for illustrating switching timing calculation according to the third embodiment. The CPU 307 executes the switching timing calculation based on the program stored in the memory 308. When receiving a print command, the CPU 307 starts the switching timing calculation. The switching timing calculation is executed for each page before the image formation is started. When the scan speeds of all the pages of a print job are the same, the switching timing calculation may be executed only before the image formation of the first page of the print job. The CPU 307 reads the shading data D1 to D10 for the first scan speed V1 being the reference speed which are stored in the memory 308 (S901), and sets the shading data D1 to D10 in the PWM signal generating portion 309. The CPU 307 determines the scan speed Vn of the relevant page based on the information included in the print command (S902).

The CPU 307 determines whether or not the determined scan speed Vn is the first scan speed V1 (S903). When the determined scan speed Vn is the first scan speed V1 (YES in S903), the CPU 307 sets the period Td for the first scan speed V1 as a switching timing Td in the PWM signal generating portion 309 (S904). The CPU 307 finishes the shading data calculation.

Figure 13A:
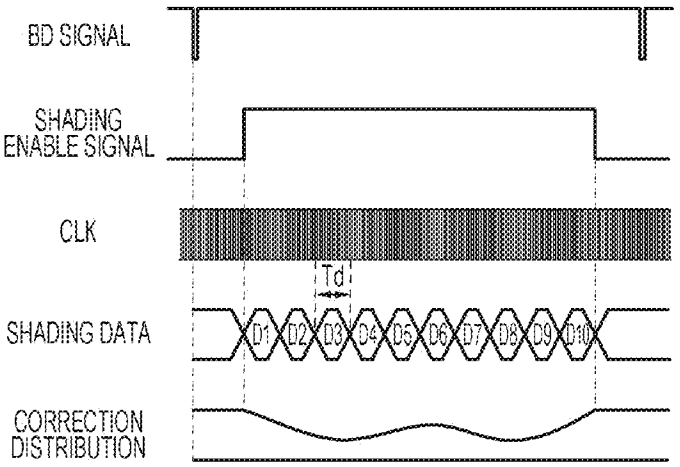
FIG. 13A and FIG. 13B are diagrams for illustrating shading data and a correction distribution according to the third embodiment.
Figure 13B:
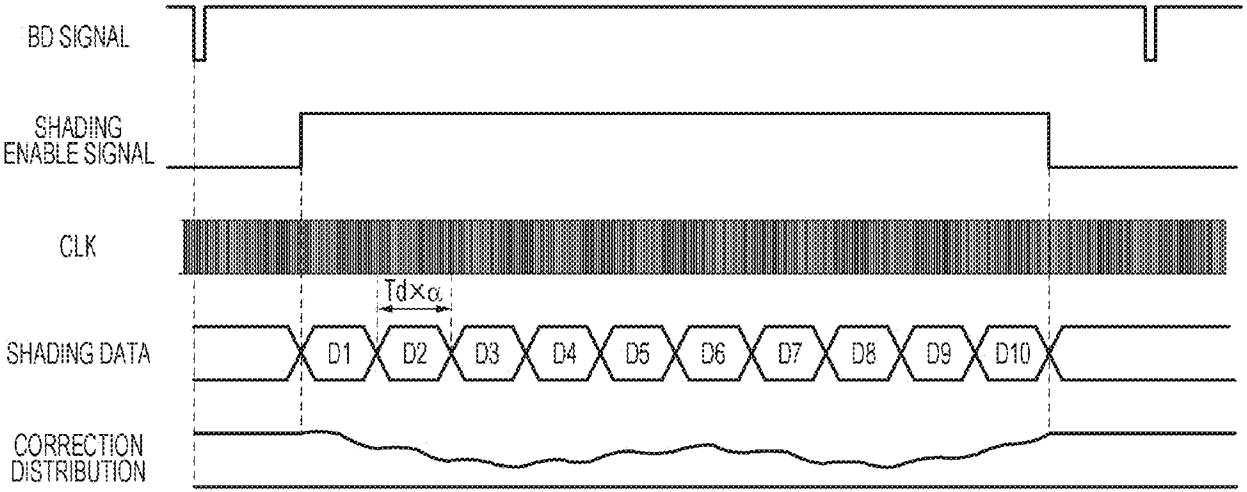

FIG. 13A and FIG. 13B are diagrams for illustrating shading data and a correction distribution according to the third embodiment. FIG. 13A is an illustration of a relationship between the shading data D1 to D10 set in the PWM signal generating portion 309 in the case of the first scan speed and the switching timing Td. The switching timing of the shading data is defined by counting pulses of the clock signal CLK with the same frequency between the scan speeds. When receiving the shading enable signal, the PWM signal generating portion 309 reads the shading data D1 to D10 based on the clock signal CLK to generate the PWM signal. The shading data D1 to D10 are read every pulse count of the clock signal CLK corresponding to the period Td (switching period) of the PWM signal. In the embodiment, the shading data D1 to D10 are read every 10,000 pulses to generate the PWM signal. The PWM signal has the duty cycle set based on the shading data D1 to D10. The correction distribution represents a distribution of the shading voltage Vshd output from the smoothing circuit 312 to which the generated PWM signal has been input.

Referring back to FIG. 12, when the determined scan speed Vn is not the first scan speed V1 (NO in S903), the CPU 307 calculates the speed ratio $\alpha$(=V1/Vn) of the first scan speed V1 to the determined scan speed Vn (S905). The CPU 307 calculates the switching timing Tdn for the determined scan speed Vn by the following expression (S906).

$$Tdn=Td\times\alpha$$

The CPU 307 sets the switching timing Tdn for the determined scan speed Vn in the PWM signal generating portion 309 (S904). The CPU 307 finishes the shading data calculation.

FIG. 13B is an illustration of a relationship between the shading data D1 to D10 set in the PWM signal generating portion 309 in the case of the determined scan speed Vn and the switching timing Tdn. In this case, the determined scan speed Vn is lower than the first scan speed V1. The switching timing Tdn is expressed by a switching period of (period Td)×$\alpha$. Assuming that the period Td is 10,000 pulses, (period Td)×$\alpha$ is 10,000×$\alpha$ pulses. The PWM signal generating portion 309 reads the shading data D1 to D10 every 10,000×$\alpha$ pulses based on the clock signal CLK to generate the PWM signal.

In the embodiment, when the scan speed is changed, the switching timing Tdn between the shading data D1, D2, D3, . . . , and D10 in the main scanning direction during one scan period of the light beam is changed instead of calculating the shading data. The changing of the switching timing Tdn depending on the change of the scan speed Vn causes a switching position of the shading data on the photosensitive drum 102 to become substantially the same regardless of the scan speed Vn. According to the embodiment, the shading data D1 to D10 for the first scan speed V1 being the reference speed can be applied to another scan speed after the change. Accordingly, it is possible to reduce a load on the shading data calculation performed by the CPU 307. The embodiment is described assuming that the determined scan speed Vn is lower than the first scan speed V1 being the reference speed, but a similar effect can be produced even when the determined scan speed Vn is higher than the first scan speed V1.

Fourth Embodiment

Next, a fourth embodiment of the present invention will be described. In the fourth embodiment, the shading correction is performed for a plurality of scan speeds with use of the shading data for a predetermined speed stored in the memory 308 instead of performing the shading data calculation. In the fourth embodiment, through the changing of the filter constant of the smoothing circuit 312 serving as a filter circuit and the period Td of the PWM signal depending on the scan speed, the shading correction is performed without performing the shading data calculation.

The second scan speed V1/$\alpha$ is lower than the first scan speed V1, and hence the distance Ds2 by which the light beam is moved in the main scanning direction during the change time $\Delta T$ is shorter than the distance Ds1. Therefore, the change amount of the light intensity per unit distance for the second scan speed V1/$\alpha$ is larger than the change amount of the light intensity per unit distance for the first scan speed V1. When the change amount of the light intensity per unit distance is changed, the shading correction cannot be adequately performed, which causes the image failure that appears to be a step difference. In view of this, in the first embodiment and the second embodiment, the number N of shading blocks is changed depending on the change of the scan speed to generate the interpolation shading data.

Figure 15A:
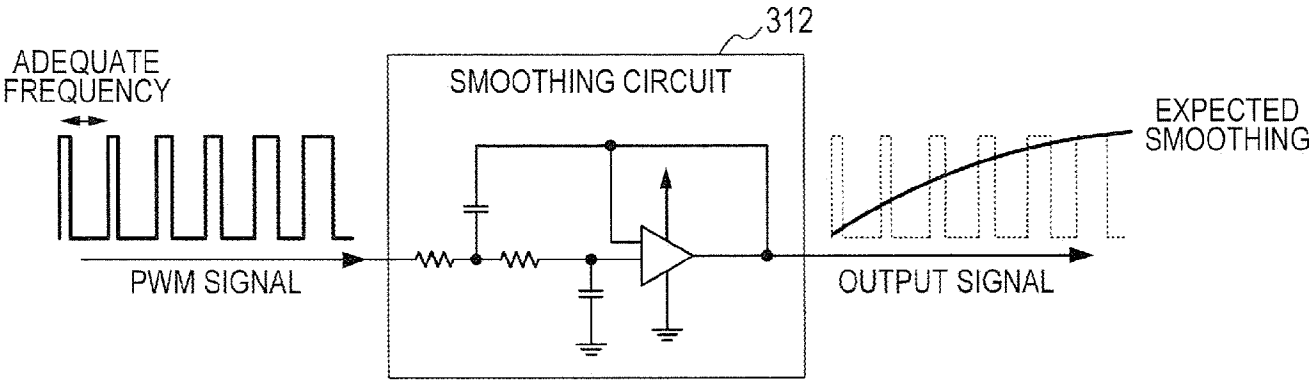
FIG. 15A and FIG. 15B are diagrams for illustrating a relationship between a frequency of a PWM signal input to a smoothing circuit and an output signal.
Figure 15B:
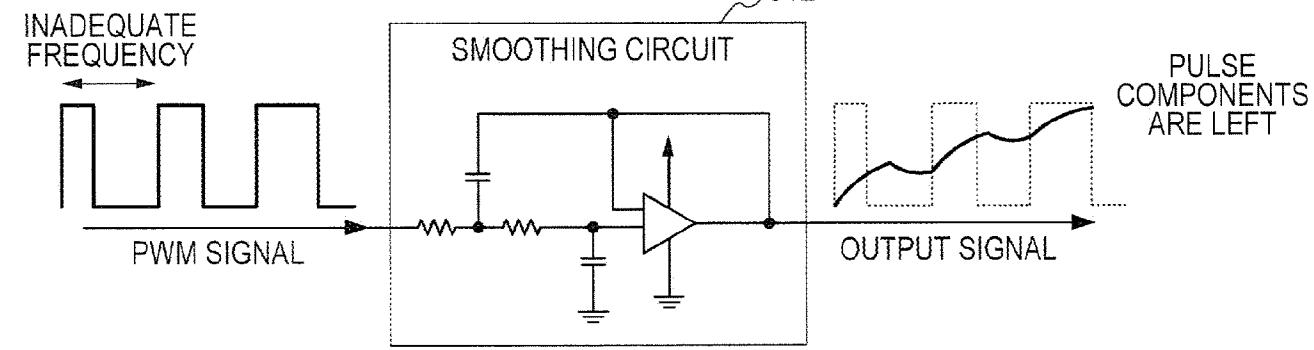

As described above, even when the shading correction is performed only through the changing of the switching timing of the shading data depending on the change of the scan speed without changing the number N of shading blocks, the image failure that appears to be a step difference is caused in the same manner as described above. As illustrated in FIG. 15A, when a PWM signal having an adequate frequency is input to the smoothing circuit 312, a relatively smoothed output signal is generated. However, as illustrated in FIG. 15B, when a PWM signal having an inadequate frequency is input to a smoothing circuit, an output signal in which pulse components are left is generated. Thus, for example, as illustrated in FIG. 13B, when the frequency of the PWM signal used for the shading correction is changed, the pulse components may be left in the correction distribution.

In view of this, in the embodiment, in order to prevent the pulse components from being left in the correction distribution when the frequency (pulse interval) of the PWM signal is changed, the filter constant of the smoothing circuit 312 is changed depending on the scan speed. The fourth embodiment will be described below with reference to FIG. 16, FIG. 17, FIG. 18A, FIG. 18B, FIG. 18C, and FIG. 18D. In the fourth embodiment, like configurations as those of the first embodiment are denoted by like reference symbols to omit the description thereof. The image forming apparatus 120 and the light scanning device 101 of the fourth embodiment are similar to those of the first embodiment, and hence description thereof is omitted herein.

(Light Source Drive Circuit)

Figure 16:
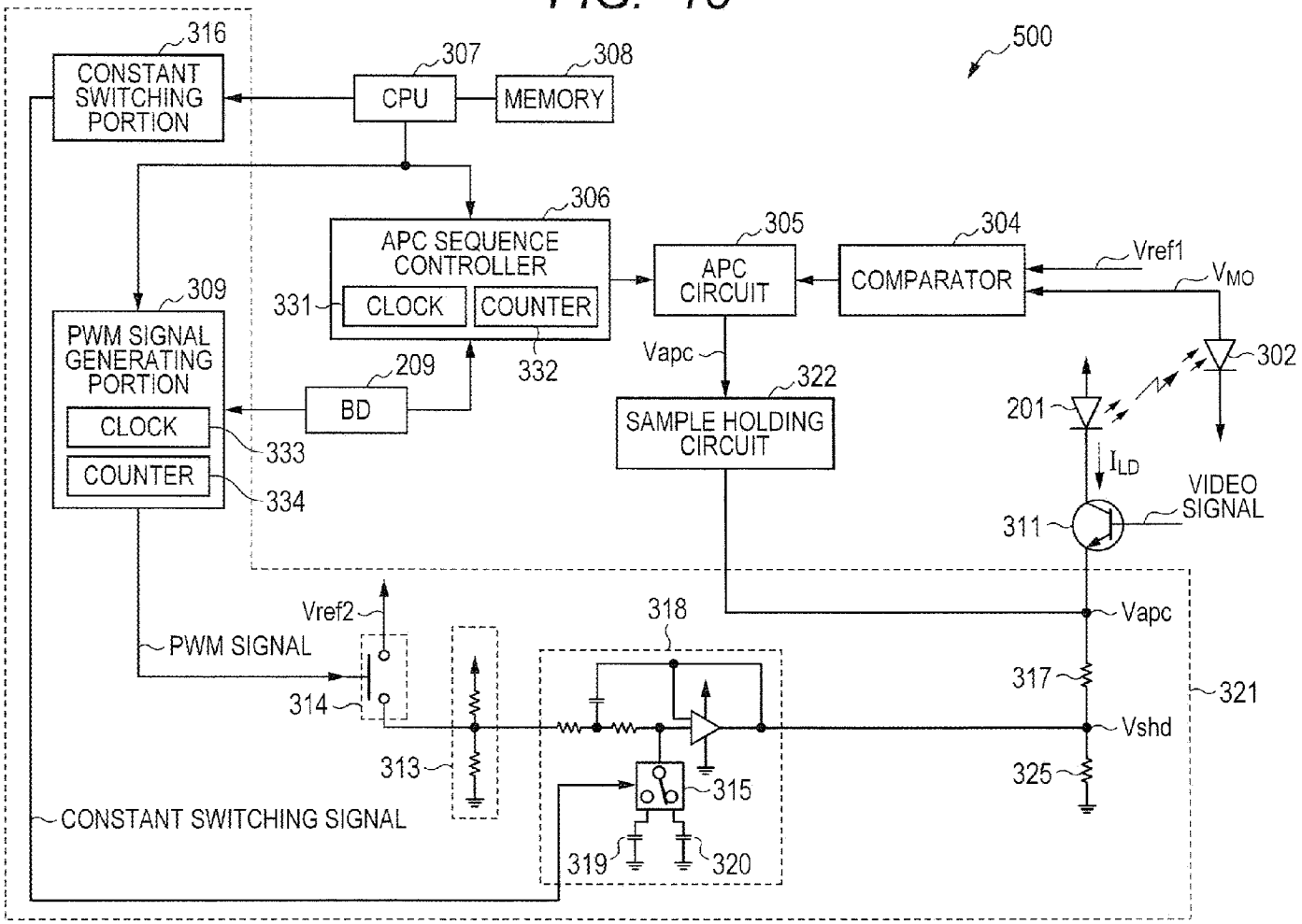
FIG. 16 is a diagram for illustrating a light source drive circuit according to a fourth embodiment.

FIG. 16 is a diagram for illustrating a light source drive circuit 500 according to the fourth embodiment. In the same manner as the light source drive circuit 300 of the first embodiment, the light source drive circuit 500 serving as the light intensity controller in the image forming apparatus 120 according to the fourth embodiment is configured to execute the APC and the shading correction control. The light source drive circuit 500 in the image forming apparatus 120 according to the fourth embodiment is different from the light source drive circuit 300 of the first embodiment in that the shading data calculating portion 310 is omitted and that a constant switching portion 316 is provided. The light source drive circuit 500 includes the CPU 307, the memory 308, the comparator 304, the APC circuit 305, the APC sequence controller 306, the sample holding circuit 322, the light source drive portion 311, and the shading circuit 321. The shading circuit 321 includes the constant switching portion 316, the PWM signal generating portion 309, the voltage switch 314, a smoothing circuit 318, and the resistor 317. The CPU 307 is electrically connected to the constant switching portion 316 and the PWM signal generating portion 309. The smoothing circuit 318 includes a constant switching circuit 315 and a plurality of capacitors 319 and 320 electrically connected to the constant switching circuit 315. The plurality of capacitors 319 and 320 have capacitances different from each other. The constant switching portion 316 serving as a constant changing unit is electrically connected to the constant switching circuit 315.

When receiving a print command, the CPU 307 stores the image forming speed of each page, which is determined based on the image formation conditions including the sheet type and the image quality input through the operation portion by the user, into the memory 308. The memory 380 stores in advance the shading data D1 to D10 corresponding to the exposure position for the first scan speed V1 being the reference speed. In the embodiment, the number N of shading blocks is set to 10.

Figure 17:
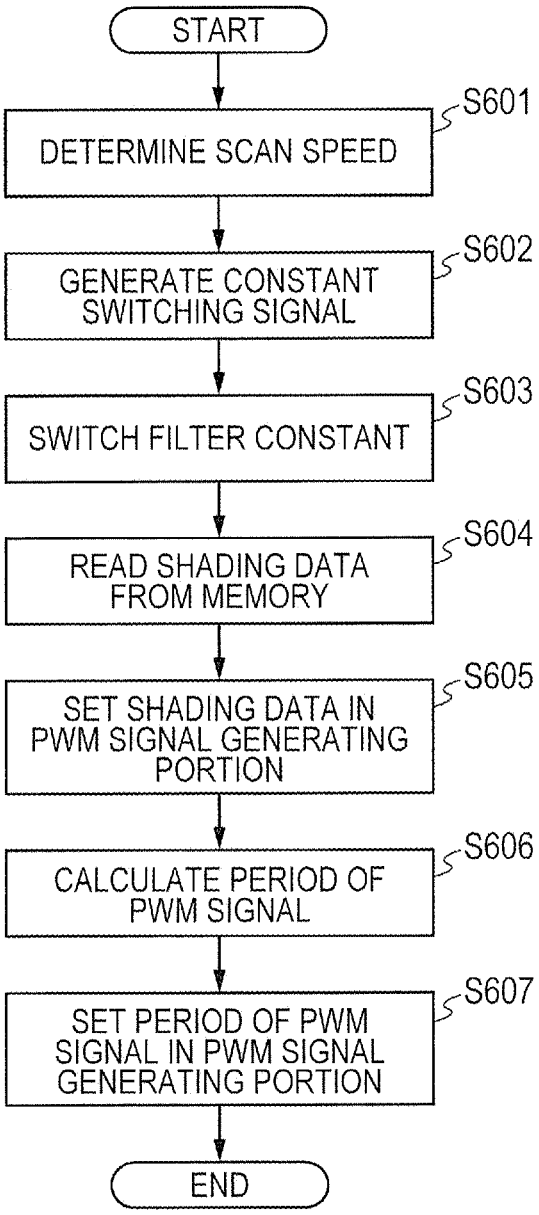
FIG. 17 is a diagram for illustrating a constant switching control operation according to the fourth embodiment.

FIG. 17 is a flowchart for illustrating a constant switching control operation according to the fourth embodiment. The CPU 307 executes the constant switching control operation based on the program stored in the memory 308. When receiving a print command, the CPU 307 starts the constant switching control operation. The constant switching control operation is executed for each page before the image formation is started. When the scan speeds of all the pages of a print job are the same, the constant switching control operation may be executed only before the image formation of the first page of the print job. The CPU 307 determines the scan speed Vn of the relevant page based on the information included in the print command (S601). The CPU 307 outputs the determined scan speed Vn to the constant switching portion 316. The CPU 307 causes the constant switching portion 316 to generate a constant switching signal depending on the determined scan speed Vn, and to output the constant switching signal to the constant switching circuit 315 of the smoothing circuit 318 (S602). The constant switching circuit 315 switches the filter constant by switching the capacitors 319 and 320 depending on the constant switching signal (S603). In the embodiment, the constant switching circuit 315 is formed of a switch, and is configured to make a selection from the two capacitors 319 and 320 connected to the constant switching circuit 315 depending on the constant switching signal. The CPU 307 reads the shading data D1 to D10 stored in the memory 308 (S604). The CPU 307 sets the shading data D1 to D10 in the PWM signal generating portion 309 (S605).

The CPU 307 calculates the period Tdn of the PWM signal output from the PWM signal generating portion 309, that is, the switching timing Tdn of the shading block, based on the determined scan speed Vn by the following expression (S606).

$$Tdn = Ts_n / N$$

In this expression, the subscript n of the reference symbol represents a value corresponding to the n-th scan speed Vn, $Ts_n$ represents a scan time for the shading correction area at the n-th scan speed Vn, and N represents the number of shading blocks. The number N of shading blocks does not depend on the scan speed because the value of 10 stored in the memory 308 are used. The CPU 307 serving as a frequency setting unit sets the calculated period Tdn of the PWM signal (frequency) in the PWM signal generating portion 309 (S607). The CPU 307 finishes the constant switching control operation.

Figure 18A:
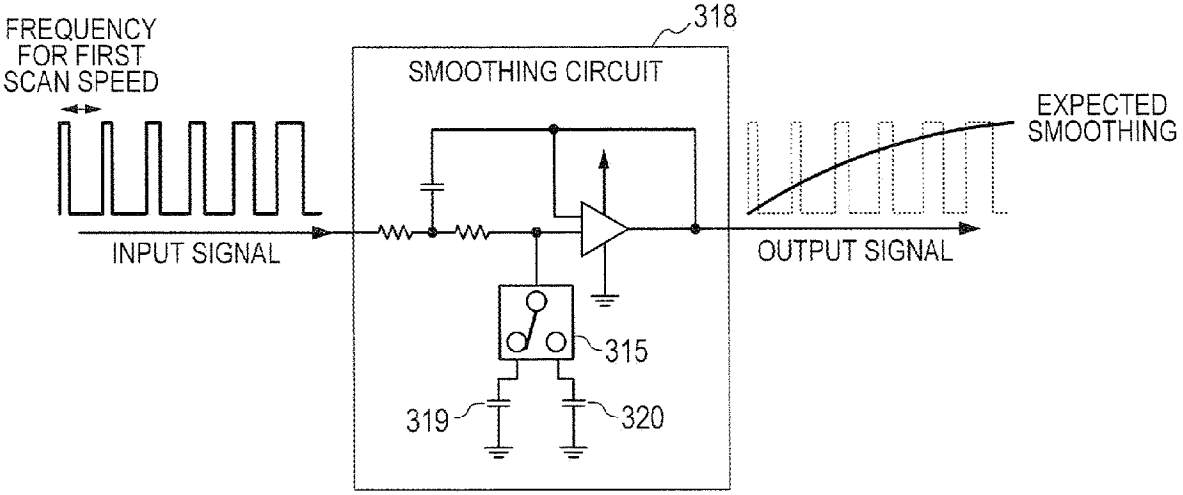
FIG. 18A, FIG. 18B, FIG. 18C, and FIG. 18D are diagrams for illustrating a relationship between a frequency of a PWM signal and an output signal according to the fourth embodiment.
Figure 18B:
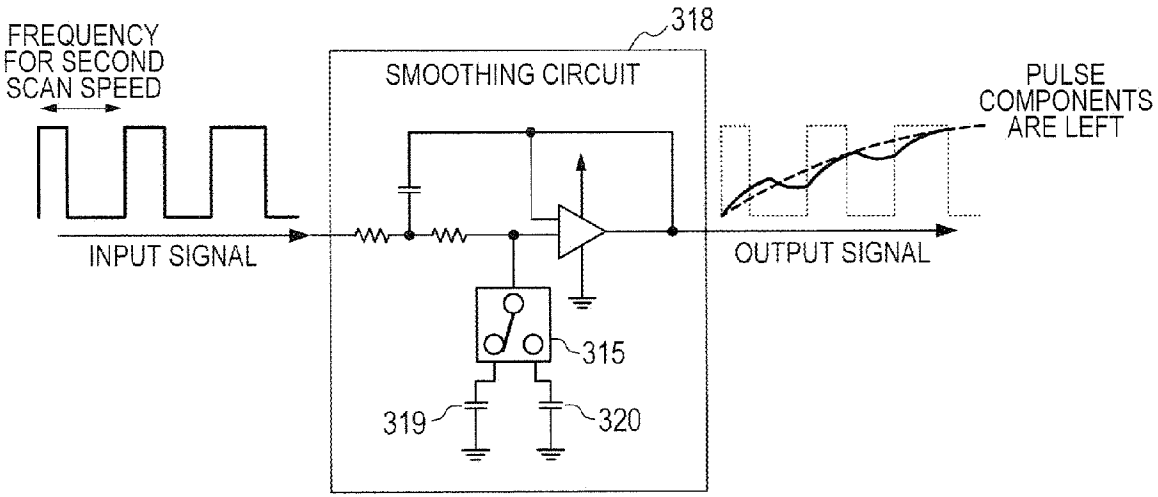
Figure 18C:
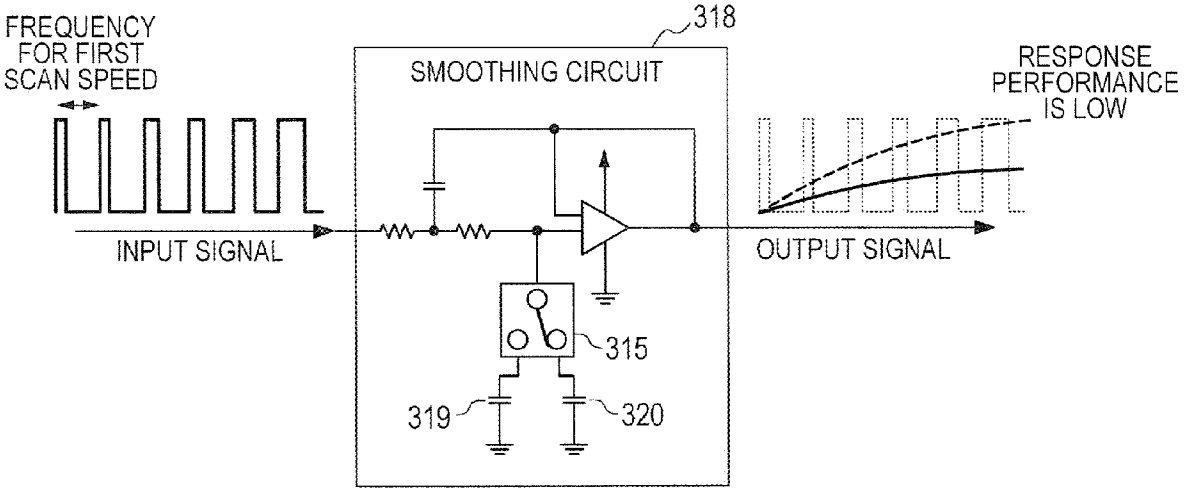
Figure 18D:
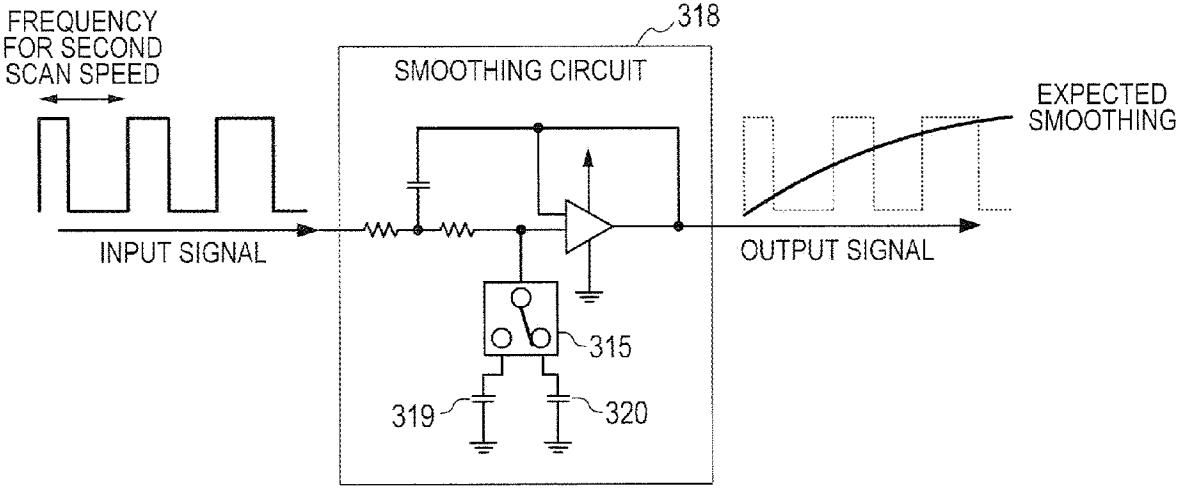

FIG. 18A, FIG. 18B, FIG. 18C, and FIG. 18D are diagrams for illustrating a relationship between a frequency of a PWM signal and an output signal according to the fourth embodiment. FIG. 18A, FIG. 18B, FIG. 18C, and FIG. 18D are illustrations of cases where at least one of the filter constant and the period of the PWM signal is switched or not switched. FIG. 18A is the illustration of the case where the period of the PWM signal adequate for the first scan speed V1 and the filter constant (capacitor 319) of the smoothing circuit 318 are set. In this case, the smoothing effect for the input signal is enhanced. FIG. 18B is the illustration of the case where the period of the PWM signal adequate for the second scan speed V2 and the filter constant (capacitor 319) of the smoothing circuit 318 adequate for the first scan speed are set. In the embodiment, the second scan speed V2 is assumed to be lower than the first scan speed V1. Therefore, the period of the PWM signal adequate for the second scan speed V2 becomes longer. The frequency of the PWM signal adequate for the second scan speed V2 falls out of the cutoff frequency defined by the capacitor 319 of the smoothing circuit 318, and a waveform having the pulse components of the input signal being left in the output signal is obtained. FIG. 18C is the illustration of the case where the period of the PWM signal adequate for the first scan speed V1 and the filter constant (capacitor 320) of the smoothing circuit 318 adequate for the second scan speed V2. In the case illustrated in FIG. 18C, the filter constant (capacitor 320) of the smoothing circuit 318 is too strong compared with the period of the PWM signal, and hence response performance becomes lower, which results in insufficient smoothing. FIG. 18D is the illustration of the case where the period of the PWM signal adequate for the second scan speed V2 and the filter constant (capacitor 320) of the smoothing circuit 318 are set. In this case, the smoothing effect for the input signal is enhanced. In this manner, in the case of switching the period Tdn of the PWM signal output from the PWM signal generating portion 309, it is possible to adequately smooth the shading voltage Vshd output from the smoothing circuit 318 by setting the filter constant adequate for the switched period Tdn.

Figure 19A:
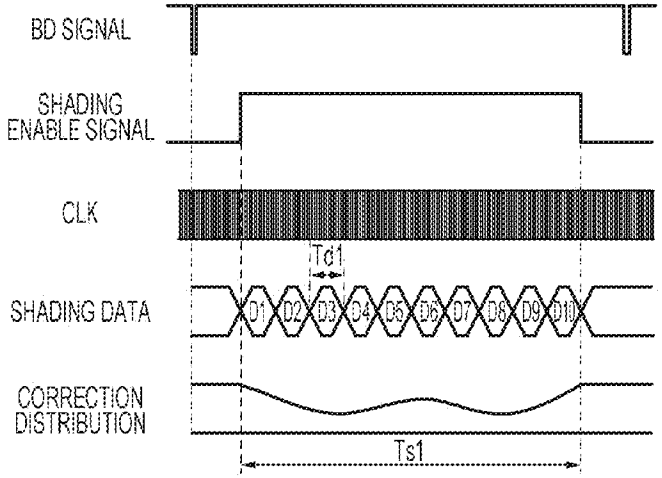
FIG. 19A and FIG. 19B are diagrams for illustrating shading data and a correction distribution according to the fourth embodiment.
Figure 19B:
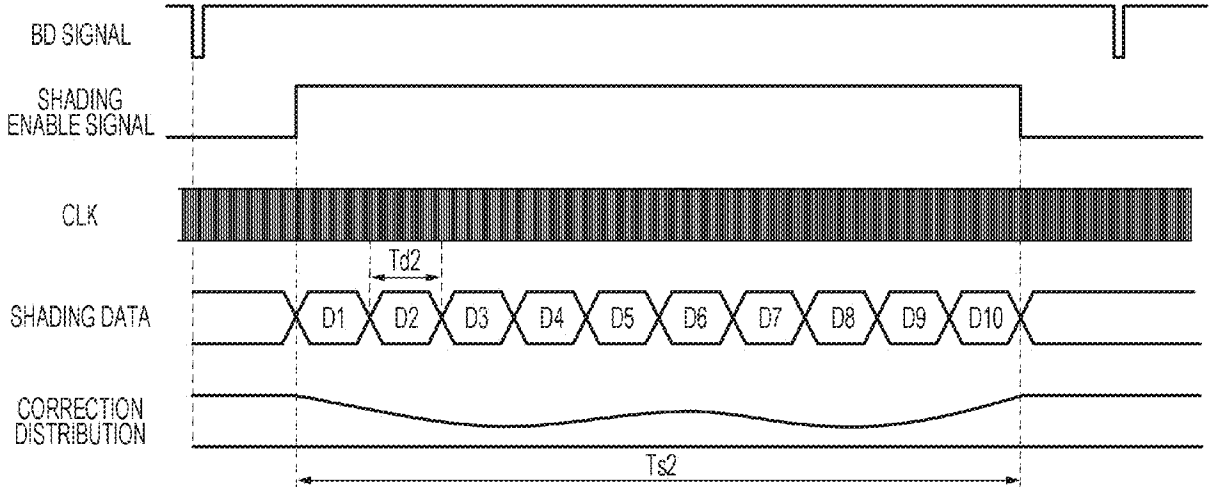
Figure 20A:
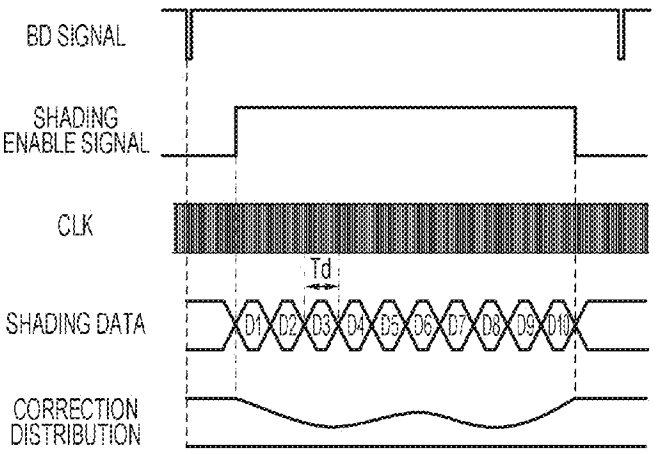
FIG. 20A and FIG. 20B are diagrams for illustrating shading data and a correction distribution in a related-art image forming apparatus.
Figure 20B:
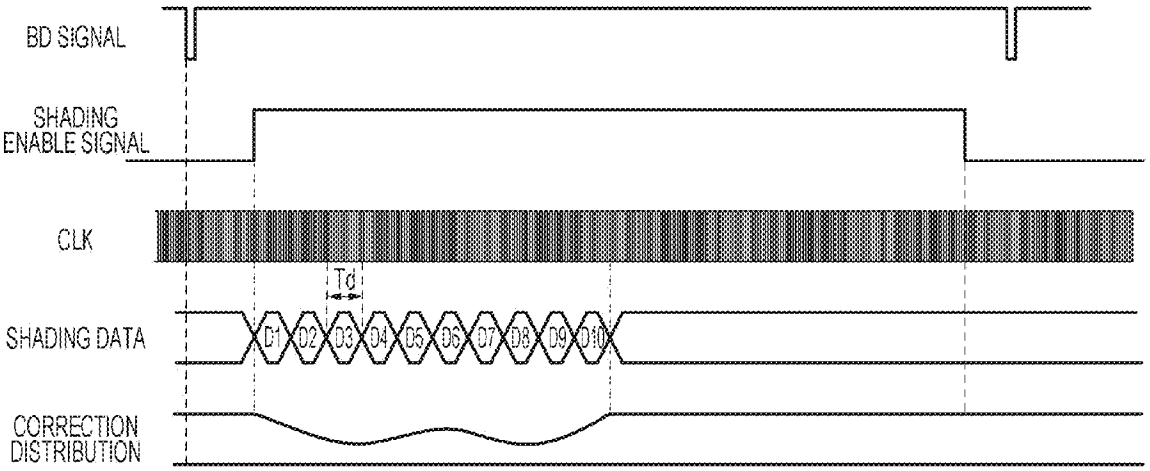

FIG. 19A and FIG. 19B are diagrams for illustrating shading data and a correction distribution according to the fourth embodiment. FIG. 19A is an illustration of the shading correction for the first scan speed V1. The scan time Ts1 for the shading correction area at the first scan speed V1 is set to 210 μs. FIG. 19B is an illustration of the shading correction for the second scan speed V2. The scan time Ts2 for the shading correction area at the second scan speed V2 is set to 420 μs. The speed ratio α of the first scan speed V1 to the second scan speed V2 is set to 2. The number N of shading blocks is 10. With reference to the expression $Tdn=Ts_n/N$, the period Td1 of the PWM signal for the first scan speed V1 is 21 μs, and the period Td2 of the PWM signal(=Td1×α=Td1×2) for the second scan speed V2 is 42 μs. The shading correction for the first scan speed V1 is performed at the period Td1 of the PWM signal(=21 μs) as illustrated in FIG. 19A. The shading correction for the second scan speed V2 being ½ (half speed) of the first scan speed V1 is performed at the period Td2(=42 μs) being two times as long as the period Td1 of the PWM signal as illustrated in FIG. 19B. Unlike the case illustrated in FIG. 13B, the filter constant of the smoothing circuit 318 is selected based on the period Td2 of the PWM signal, and hence as described with reference to FIG. 18D, the light intensity output is obtained with a smoothed correction distribution in which the pulse components of the PWM signal illustrated in FIG. 19B are not left.

In the embodiment, the constant switching circuit 315 is configured to make a selection from the two capacitors 319 and 320. However, the constant switching circuit 315 may be configured to make a selection from three or more capacitors. The description of the embodiment is also directed to the configuration for changing the capacitance of the capacitor of the smoothing circuit 318 in order to switch the cutoff frequency of the smoothing circuit 318, but the capacitance of another capacitor or the resistance value of the resistor may be changed depending on the condition to be obtained.

According to the fourth embodiment, the filter constant of the smoothing circuit 318 and the period of the PWM signal to be input are changed depending on the scan speed Vn. With this configuration, through the use of the shading data corresponding to a predetermined scan speed, the smoothing circuit 318 can perform the shading correction even for a plurality of other scan speeds without impairing a desired smoothing effect. Accordingly, it is possible to suppress the density unevenness of an image.

According to the embodiments described above, the light intensity of the light beam in the scanning direction at the second scan speed can be corrected with use of the light intensity correction data corresponding to the first scan speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-090308, filed Apr. 28, 2016, which is hereby incorporated by reference herein in its entirety.

What is claimed is:

1. An image forming apparatus, which is configured to form an image on a recording medium, the image forming apparatus comprising:

an image forming portion comprising:

a photosensitive member to be rotated;

a light source configured to emit a light beam;

a deflection unit configured to deflect the light beam emitted from the light source so that the light beam is scanned on the photosensitive member;

a developing unit configured to develop an electrostatic latent image, which is formed on the photosensitive member through scanning of the light beam, with use of toner; and a transfer unit configured to transfer a toner image developed on the photosensitive member onto the recording medium, the image forming portion being configured to control an image forming speed depending on a type of the recording medium on which the image is to be formed, the image forming speed including: a conveyance speed of the recording medium; a rotation speed of the photosensitive member; and a scan speed of the light beam;

a fixing unit configured to fix the toner image, which has been transferred onto the recording medium, to the recording medium;

a storage unit configured to store a light intensity correction data used for correcting a light intensity of the light beam to a light intensity corresponding to each of a plurality of different positions in a scanning direction of the light beam in association with a first scan speed of the light beam;

a setting unit configured to:

set a light intensity correction data corresponding to an exposure position from among a plurality of light intensity correction data stored in the storage unit according to exposure positions of the light beam in the scanning direction while the light beam is being scanned on an image forming area of the photosensitive member at the first scan speed;

calculate a light intensity correction data corresponding to a position between the plurality of different positions in the scanning direction based on the plurality of light intensity correction data stored in the storage unit; and set the light intensity correction data stored in the storage unit and a calculated light intensity correction data according to the exposure position of the light beam in the scanning direction while the light beam is being scanned on the image forming area of the photosensitive member at a second scan speed lower than the first scan speed; and a light intensity controller configured to control the light intensity of the light beam based on the light intensity correction data set by the setting unit, wherein the setting unit fixes a switching period of the light intensity correction data while the light beam is being scanned on the image forming area of the photosensitive member regardless of the scan speed, and switches the light intensity correction data according to the exposure position of the light beam at the switching period to set the light intensity correction data.

2. An image forming apparatus according to claim 1, wherein the image forming portion further comprises:

a periodic signal generator configured to generate a periodic signal indicating a scan period of the light beam;

a clock signal generator configured to generate a clock signal having a frequency higher than a frequency of the periodic signal; and a counter configured to count the clock signal with the periodic signal being used as a reference, and wherein the setting unit switches the light intensity correction data depending on a count value of the counter.

3. An image forming apparatus according to claim 2, wherein the periodic signal generator comprises a light receiving element configured to receive the light beam deflected by the deflection unit, and generates the periodic signal by the light receiving element receiving the light beam.

4. An image forming apparatus according to claim 1, wherein the light intensity controller comprises:

an output unit configured to output a PWM signal having a pulse width set by the setting unit;

a smoothing circuit configured to smooth the PWM signal; and a detector configured to detect the light intensity of the light beam emitted from the light source, and wherein the light intensity controller controls a light intensity control voltage so that the light intensity of the light beam detected by the detector becomes a target light intensity, and controls a value of a current to be supplied to the light source based on the light intensity control voltage and an output voltage of the smoothing circuit.

5. An image forming apparatus, which is configured to form an image on a recording medium, the image forming apparatus comprising:

an image forming portion comprising:

a photosensitive member to be rotated;

a light source configured to emit a light beam;

a deflection unit configured to deflect the light beam emitted from the light source so that the light beam is scanned on the photosensitive member;

a developing unit configured to develop an electrostatic latent image, which is formed on the photosensitive member through scanning of the light beam, with use of toner;

a transfer unit configured to transfer a toner image developed on the photosensitive member onto the recording medium; and the image forming portion being configured to control an image forming speed depending on a type of the recording medium on which the image is to be formed, the image forming speed including: a conveyance speed of the recording medium;

a rotation speed of the photosensitive member; and a scan speed of the light beam;

a fixing unit configured to fix the toner image, which has been transferred onto the recording medium, to the recording medium, a setting unit configured to set a light intensity correction data corresponding to an exposure position from among a plurality of light intensity correction data according to an exposure position of the light beam in a scanning direction of the light beam while the light beam is being scanned on an image forming area of the photosensitive member, the light intensity correction data being used for correcting a light intensity of the light beam to a light intensity corresponding to each of a plurality of different positions in the scanning direction of the light beam; and a light intensity controller configured to control the light intensity of the light beam based on the light intensity correction data set by the setting unit, wherein the setting unit controls a switching period for switching a setting of the light intensity correction data depending on the scan speed of the light beam controlled by the image forming portion.

6. An image forming apparatus according to claim 5, wherein the image forming portion further comprises:

a periodic signal generator configured to generate a periodic signal indicating a scan period of the light beam;

a clock signal generator configured to generate a clock signal having a frequency higher than a frequency of the periodic signal; and a counter configured to count the clock signal with the periodic signal being used as a reference, and wherein the setting unit switches the light intensity correction data depending on a count value of the counter.

7. An image forming apparatus according to claim 6, wherein the periodic signal generator comprises a light receiving element configured to receive the light beam deflected by the deflection unit, and generates the periodic signal by the light receiving element receiving the light beam.

8. An image forming apparatus according to claim 5, wherein the light intensity controller comprises:

an output unit configured to output a PWM signal having a pulse width set by the setting unit;

a smoothing circuit configured to smooth the PWM signal; and a detector configured to detect the light intensity of the light beam emitted from the light source, and wherein the light intensity controller controls a light intensity control voltage so that the light intensity of the light beam detected by the detector becomes a target light intensity, and controls a value of a current to be supplied to the light source based on the light intensity control voltage and an output voltage of the smoothing circuit.

* * * * *